US011944871B2

(12) United States Patent
Singer et al.

(10) Patent No.: US 11,944,871 B2
(45) Date of Patent: Apr. 2, 2024

(54) MOTORIZED FITNESS WHEEL

(71) Applicant: ZeroWheel, LLC, Armonk, NY (US)

(72) Inventors: Neil Singer, Armonk, NY (US); Pranav Solanki, Armonk, NY (US); Brian Singer, Armonk, NY (US); Kenneth Pasch, Dover, MA (US)

(73) Assignee: ZEROWHEEL, LLC, Armonk, NY (US)

( * ) Notice: Subject to any disclaimer, the term of this patent is extended or adjusted under 35 U.S.C. 154(b) by 0 days.

(21) Appl. No.: 18/192,520

(22) Filed: Mar. 29, 2023

(65) Prior Publication Data

US 2024/0009521 A1 Jan. 11, 2024

Related U.S. Application Data

(63) Continuation of application No. 18/160,170, filed on Jan. 26, 2023, which is a continuation of application No. 17/860,892, filed on Jul. 8, 2022.

(51) Int. Cl.

| | |
|---|---|
| ***A63B 24/00*** | (2006.01) |
| ***A63B 21/005*** | (2006.01) |
| ***A63B 22/20*** | (2006.01) |

(52) U.S. Cl.

CPC ..... *A63B 24/0087* (2013.01); *A63B 21/0058* (2013.01); *A63B 22/20* (2013.01); (Continued)

(58) Field of Classification Search

CPC . A63B 24/0087; A63B 21/0058; A63B 22/20; A63B 2024/0093; A63B 2220/13; A63B 2220/30; A63B 2220/833

See application file for complete search history.

(56) References Cited

U.S. PATENT DOCUMENTS

2012/0157274 A1* 6/2012 MacColl ..... A63B 21/00185 482/132
2013/0017936 A1 1/2013 Olson et al.
(Continued)

FOREIGN PATENT DOCUMENTS

CN 107096174 A * 8/2017
CN 109999414 A 7/2019
(Continued)

OTHER PUBLICATIONS

International Search Report and Written Opinion in PCT Application No. PCT/US23/69279, dated Oct. 12, 2023.

*Primary Examiner* — Sundhara M Ganesan
*Assistant Examiner* — Jacqueline N L Loberiza
(74) *Attorney, Agent, or Firm* — Leason Ellis LLP

(57) ABSTRACT

Systems and methods disclosed herein concern a motorized fitness wheel. The fitness wheel includes a wheel that rotates about an axle with two handles that extend outward from respective sides of the wheel along the rotational axis. In use, the user grasps the handles with their hands and rolls the wheel back and forth along the floor. A motor is configured to apply a torque to the wheel in either forward or backward direction to apply resistance or assistance and enhance the exercise. A position sensor feeds positional information of the motor to a microcontroller. Based on the positional information, the microcontroller dynamically controls the output torque of the motor as a function of one or more torque trajectories. The torque trajectories define the output torque of the motor over a cycle of the exercise as a function a spatial variable (e.g., wheel position) and/or time.

30 Claims, 19 Drawing Sheets

Section A-A

(52) U.S. Cl.
CPC ... *A63B 2024/0093* (2013.01); *A63B 2220/13* (2013.01); *A63B 2220/30* (2013.01); *A63B 2220/833* (2013.01)

(56) References Cited

U.S. PATENT DOCUMENTS

| | | | | |
|---|---|---|---|---|
| 2015/0328491 | A1 | 11/2015 | Miller et al. | |
| 2018/0021616 | A1* | 1/2018 | Orady | A63B 21/153 482/5 |
| 2018/0021629 | A1* | 1/2018 | DeLuca | A63B 21/00069 482/4 |
| 2019/0105530 | A1 | 4/2019 | Tholkes et al. | |
| 2021/0128399 | A1 | 5/2021 | Wersland et al. | |
| 2021/0394011 | A1* | 12/2021 | Neuhaus | A63B 21/151 |
| 2022/0047921 | A1 | 2/2022 | Bissonnette et al. | |
| 2023/0112877 | A1* | 4/2023 | Chuah | A63B 71/0686 482/132 |

FOREIGN PATENT DOCUMENTS

| | | | | | |
|---|---|---|---|---|---|
| CN | 210933604 | U | | 7/2020 | |
| CN | 114129964 | A | | 3/2022 | |
| JP | H0986476 | A | * | 3/1997 | B62M 6/45 |

* cited by examiner

Section A-A

Legend

- ▲ Maximum Resistance, +6 N·m
- ■ Neutral, 0 N·m
- ● Maximum Assistance, –6 N·m

Legend

- ▲ Maximum Resistance, +6 N·m
- ■ Neutral, 0 N·m
- ● Maximum Assistance, –6 N·m

Legend

- ▲ Maximum Resistance, +6 N·m
- ■ Neutral, 0 N·m
- ● Maximum Assistance, −6 N·m

Resistance Torque Curve (Example)

MOTORIZED FITNESS WHEEL

CROSS REFERENCE TO RELATED APPLICATIONS

The present application is a continuation of, and claims priority from, U.S. Non-Provisional patent application Ser. No. 18/160,170, titled "MOTORIZED FITNESS WHEEL," filed Jan. 26, 2023, which is a continuation of U.S. Non-Provisional patent application Ser. No. 17/860,892, titled "MOTORIZED FITNESS WHEEL," filed Jul. 8, 2022, which are hereby incorporated by reference in their respective entireties herein.

FIELD OF THE DISCLOSURE

The present invention relates to wheeled exercise devices, and more particularly to electric motor assisted wheeled exercise devices used to achieve core and upper-body workouts.

BACKGROUND OF THE DISCLOSURE

§ 1.1 Related Art

Wheel-based exercise devices (also referred to as fitness wheels, exercise wheels, or abdominal exercisers) are often used to achieve core and upper-body workouts. Such devices typically consist of a wheel having a diameter of about six to eight inches mounted in the center of a shaft, with static handles extending axially from both sides of the wheel. The user grasps the device by the handles and rolls the wheel back and forth along the floor or other exercising surface.

Different types of wheel-based exercise devices are best categorized by their internal mechanisms, which ultimately influence the exercise experience.

The most common internal mechanism is simply a wheel-bearing-shaft assembly, favored for mass-production. Since users are restricted to exercising by resisting their own body weight, most beginners cannot complete even a single exercise repetition, and it is frustrating to get started. Meanwhile, advanced users find it difficult to get a sufficient workout, so they need to compensate by doing many high-repetition sets. The existing "abdominal exercisers" do little to correct these problems. Internal mechanisms that provide assistance and/or resistance to the user include bungee-assisted mechanisms, pneumatic mechanisms, spring-assisted mechanisms, and motors.

The bungee-assisted mechanism is a crude solution to the above issues, as it employs elastic cords, bands, or straps to give assistance (Note: In marketing materials these are often called "resistance bands" but the function is to assist (not "resist") the user in pulling the wheel back; for the purpose of this patent, we call a force that pushes against the forward motion "assistance"). The bungee solution sacrifices portability and usability by requiring more equipment, especially if the user intends to vary their assistance as they progress over time. The bungee cord solution is very limiting in the types and amount of assistance it provides. Aside from functional disadvantages, the bungee cords can pose a significant safety issue if the user misassembles the product or slips and releases the handles. If the user reasonably decides to bail out during the exercise, a large amount of stored energy in the bungee cords may be expelled dangerously towards the user.

Pneumatic mechanisms change tire pressure to change the effective friction between the wheel and the ground, thus resisting inertia during the exercise. The pneumatic solution, however, only offers resistance over a limited range and can only provide a constant amount of difficulty throughout each repetition of exercise.

The spring-assisted mechanism uses an internal torsional spring at the center of the wheel to provide assistance. However, the user is limited in the amount of received assistance due to the material properties that define the internal spring. The geometry of torsional springs also restricts the mechanism to roll in one direction from the resting position of the exercise. As a result, only beginners benefit from the assistive properties of the mechanism; experienced users are unable to make their workout more difficult than the standard, bearing wheel.

Motors have been used to evolve fitness wheels beyond spring-assisted mechanisms. Motor-driven, geared fitness wheels with manual speed-control have been developed. Some motor-assisted devices attempt to back-drive the motor to generate electricity as a means of providing exercise. Supplementary to the features above, motor control has been adjusted to provide a resistance against the user on the rollback of the exercise, increasing the exercise difficulty for more experienced users. The motorized fitness wheel devices in the prior art have not had commercial success because they use basic motor control methods (e.g. constant speed control), resulting in a sub-par exercise experience for the user. None of the existing motor-assisted fitness wheels specifies dynamic or real-time control of the motor characteristics of the present invention that increase accessibility and promote exercise progression (i.e., increasing difficulty over time). The existing motor-assisted fitness wheels also lack effective and practical safety mechanisms which would prevent the motor from running when the exercise is aborted. Lastly, the existing motor-assisted fitness wheels do not have intuitive, engaging user interfaces.

It is with respect to these and other considerations that the disclosure made herein is presented.

SUMMARY OF THE DISCLOSURE

According to an aspect of the present disclosure, a motorized exercise wheel is provided for performing an exercise having at least one cycle in which a user rolls the wheeled mechanism (we will refer to it as a "wheel" understanding that it may have more than one wheel) along a surface in a forward direction from an approximate resting position to an extended position and then rolls the wheel along the surface in a backward direction from the extended position toward the resting position. The motorized exercise wheel comprises a wheel assembly including a ground-contacting element, the ground-contacting element being configured to contact the surface and rotate about an axle in either a forward rotational direction and a backward rotational direction and thereby roll along the ground in either the forward or backward directions. The motorized exercise wheel also comprises a first and second handle configured to receive each hand of a user, the first and second handle extending outward from respective sides of the wheel assembly. The motorized exercise wheel also comprises a motor coupled to the wheel assembly and configured to apply an output torque to the ground-contacting element in either the forward rotational direction or the backward rotational direction. The motorized exercise wheel also comprises a microcontroller comprising one or more processors and being configured to control an output torque of the motor. The motorized exercise wheel also includes a sensor in communication with the microcontroller and configured to determine a movement variable of the exercise wheel. The motorized exercise wheel also comprises a non-transitory computer readable storage medium accessible by the microcontroller. Additionally, the microcontroller is further configured to control the output torque of the motor over the exercise cycle as a function of the determined movement variable.

According to a further aspect a method of operating a motorized exercise wheel for performing an exercise is disclosed. The exercise involves at least one cycle in which a user rolls the wheel along a surface in a forward direction from an approximate resting position to an extended position and then rolls the wheel along the surface in a backward direction from the extended position toward the resting position, thus forming the cycle. The wheel includes a wheel assembly including a ground contacting element, an electric motor coupled to the wheel assembly, first and second handles extending from the wheel assembly for handling by the user and a microcontroller. The method, which is performed by the microcontroller, comprises a step of determining, using a sensor, a movement variable concerning movement of the exercise wheel during the exercise, the movement variable being determined with the sensor throughout the at least one cycle. The method also includes determining, a target output torque for the motor based at least in part on the movement variable determinations. The method also includes controlling an output torque of the motor over the exercise cycle as a function of the target output torque.

These and other aspects, features, and advantages can be appreciated from the accompanying description of certain embodiments of the invention and the accompanying drawing figures and claims.

BRIEF DESCRIPTION OF THE DRAWING FIGURES

It is noted that the drawings are illustrative and are not necessarily to scale.

DESCRIPTION OF CERTAIN EMBODIMENTS OF THE DISCLOSURE

§ 2.1 Overview

Figure 1A:
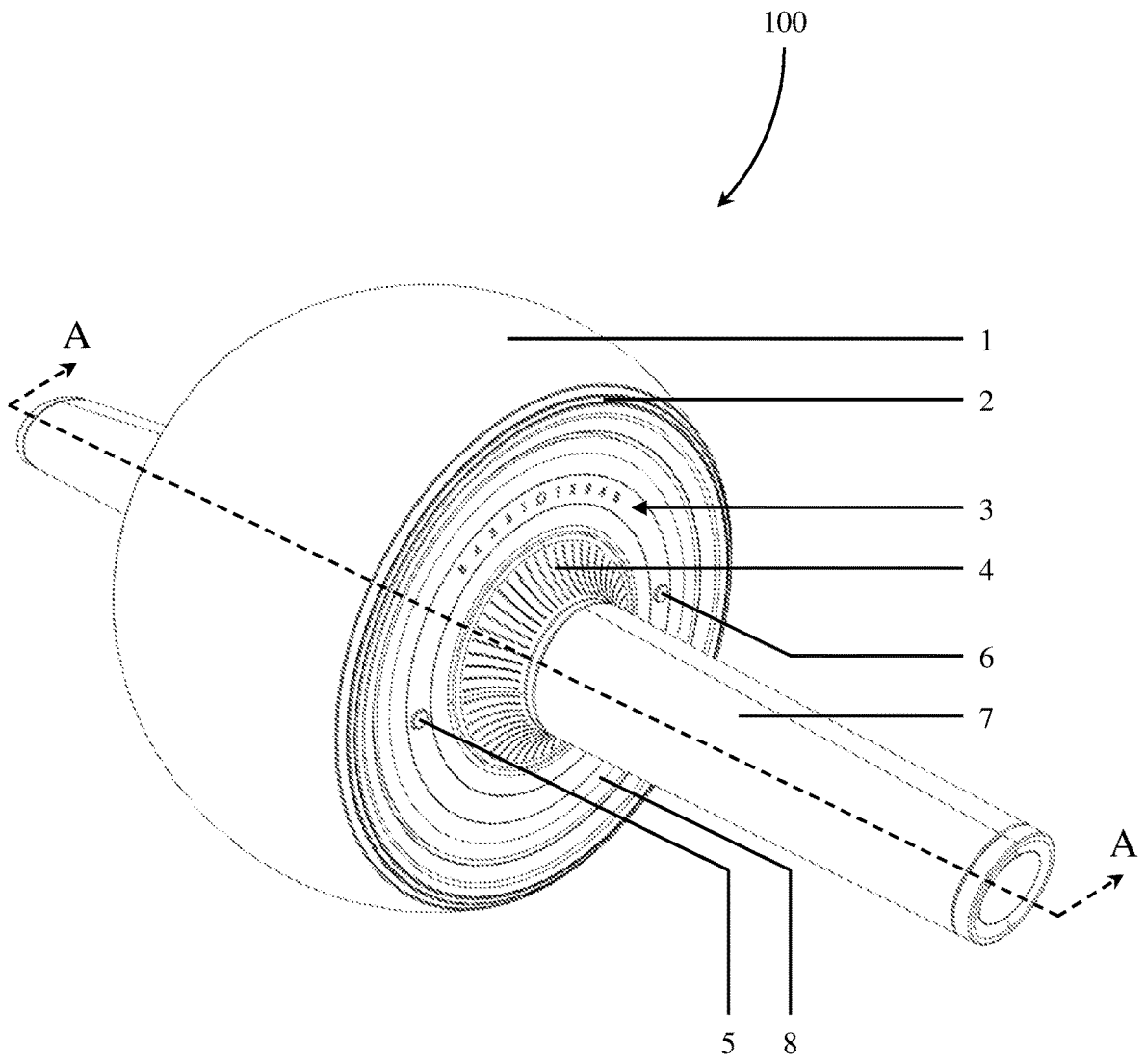
FIG. 1A is a perspective view of an exemplary motorized fitness wheel, according to an embodiment.
Figure 1B:
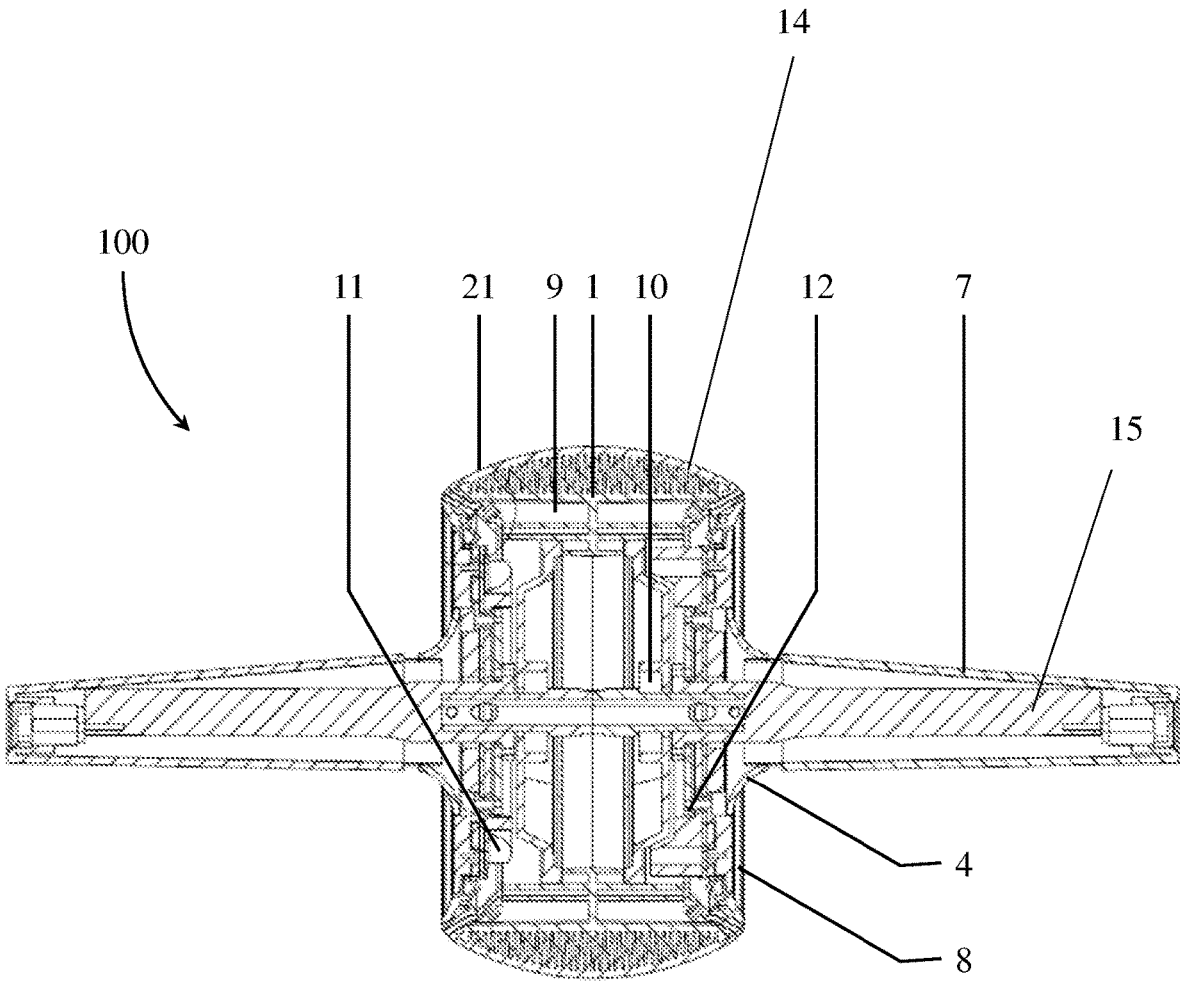
FIG. 1B is a cross-sectional view of the fitness wheel of FIG. 1A taken along line A-A, according to an embodiment.

By way of overview and introduction, the systems and methods disclosed herein concern a motorized fitness wheel. FIG. 1A is a perspective view of an exemplary fitness wheel 100 according to an embodiment. FIG. 1B is a cross-sectional view of the fitness wheel 100 taken along line A-A shown in FIG. 1A such that the top half of the fitness wheel has been cut-away to reveal internal components of the fitness wheel.

As shown in FIGS. 1A and 1B, the hardware of the fitness wheel 100 comprises of a motor 9, which is mounted inside of a wheel 1. At the interior radius of the motor lies a bearing assembly 10, configured to allow the motor to provide torque between the rotating portion of the wheel 14 and a static axle shaft 15 that is coupled to the handles 7. The outer radius of the wheel includes a ground-contacting element 21 configured to roll along the ground. Handles 7 extend outward from each side of the wheel, generally along the rotational axis of the wheel, and are intended to be grasped by the user during use. The wheel is closed off by two hubcaps 8, the interior of which houses internal components including batteries 11, electronics 12, the motor 9 and the like.

A user interface is provided on the outside of one of the hubcaps and comprises a physical interface including a rotatable difficulty selection rotary dial 4, Bluetooth button 5, and power button 6. The fitness wheel 100 also comprises visual indicators such as an exercise difficulty display 3, which displays the difficulty selected by the user using, e.g., the difficulty selection rotary dial 4. Visual indicators also include LEDs 2, which are used to provide feedback to the user in regard to exercise status and progress, making the exercise experience more engaging and enjoyable.

Figure 2:
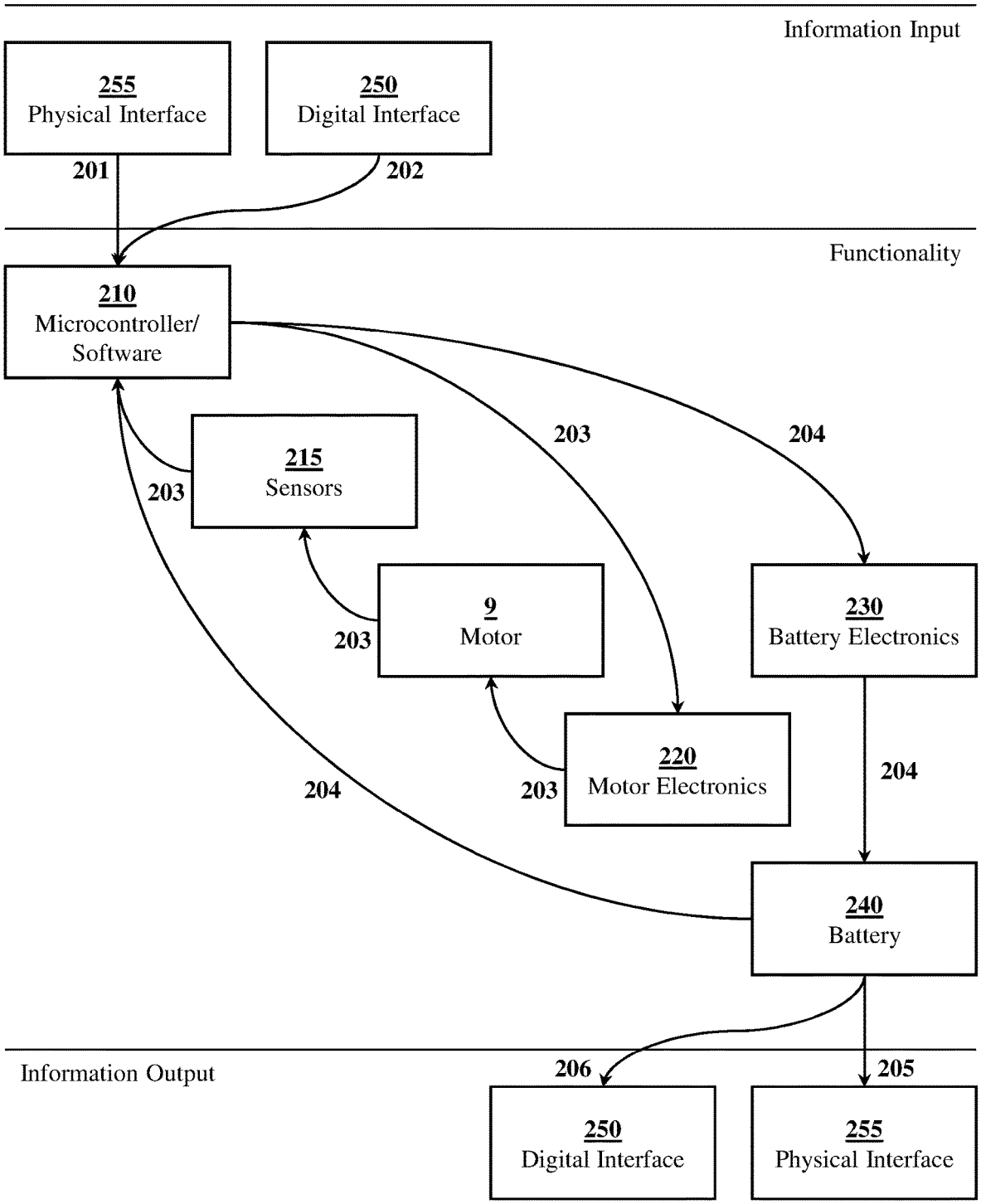
FIG. 2 is a block diagram illustrating the interconnected and interoperating mechanical, electrical, and software components of a motorized fitness wheel, according to an embodiment.
Figure 3:
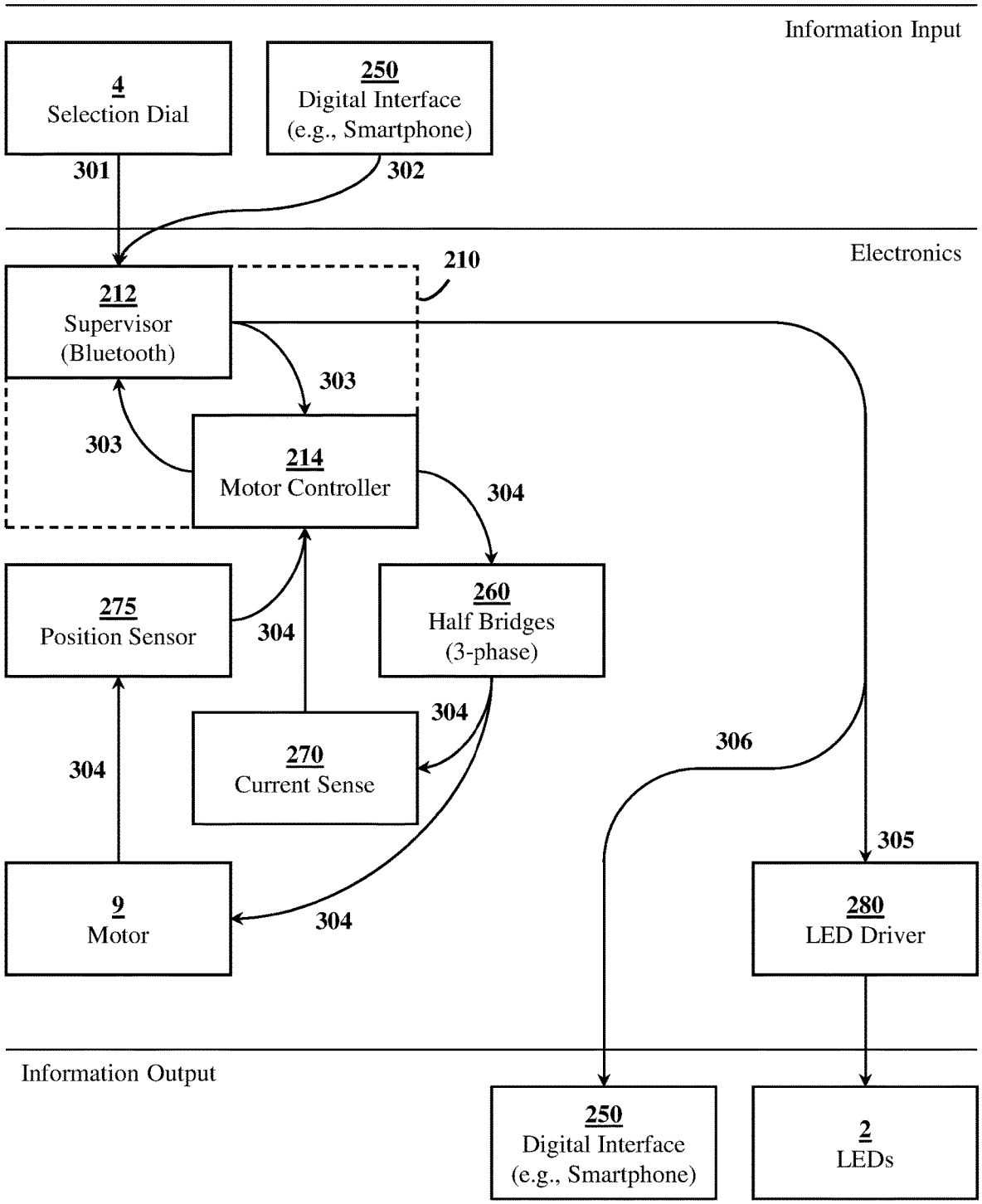
FIG. 3 is a block diagram showing an exemplary configuration of the electronics of a motorized fitness wheel, according to an embodiment.
Figure 4:
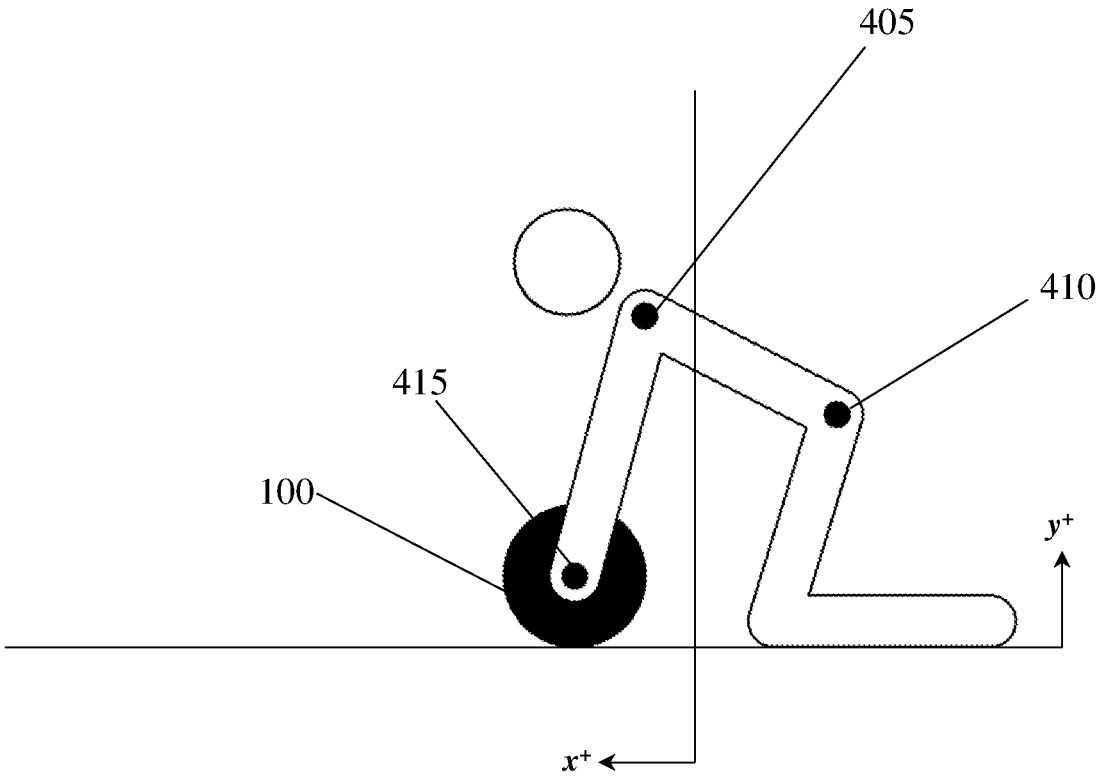
FIG. 4 shows one possibility for the user's form at start of exercise. This is the animation generated by numerically simulating an actual exercise using the fitness wheel according to an embodiment.
Figure 5:
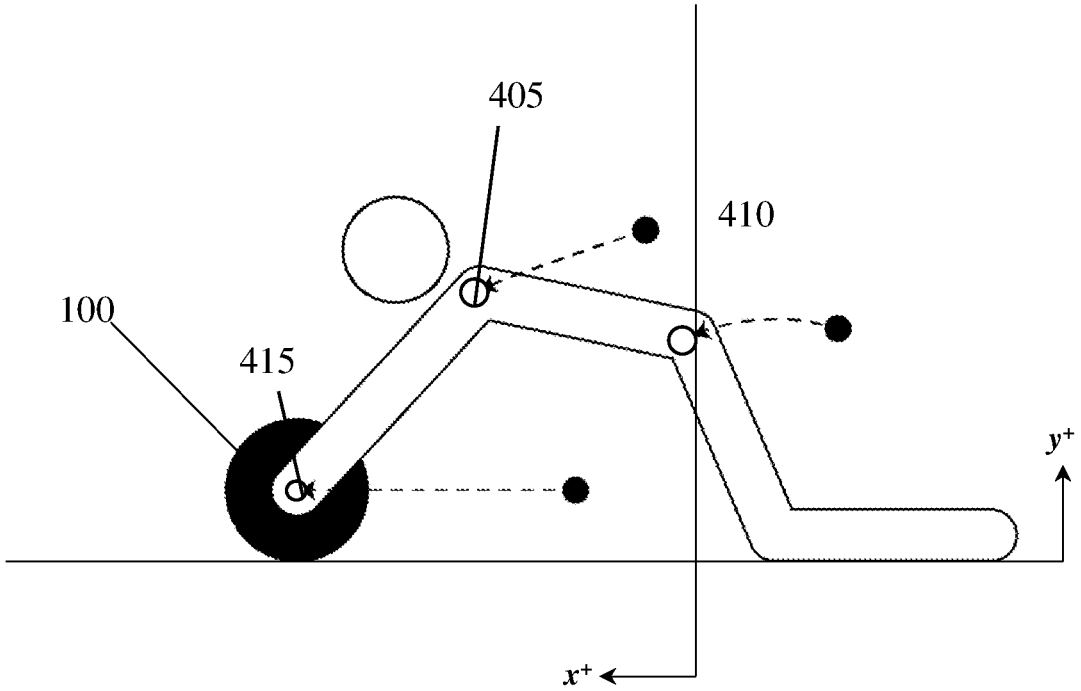
FIG. 5 shows one possibility for the user's form during initial extension. This is the animation generated by numerically simulating an actual exercise using the fitness wheel according to an embodiment.
Figure 6:
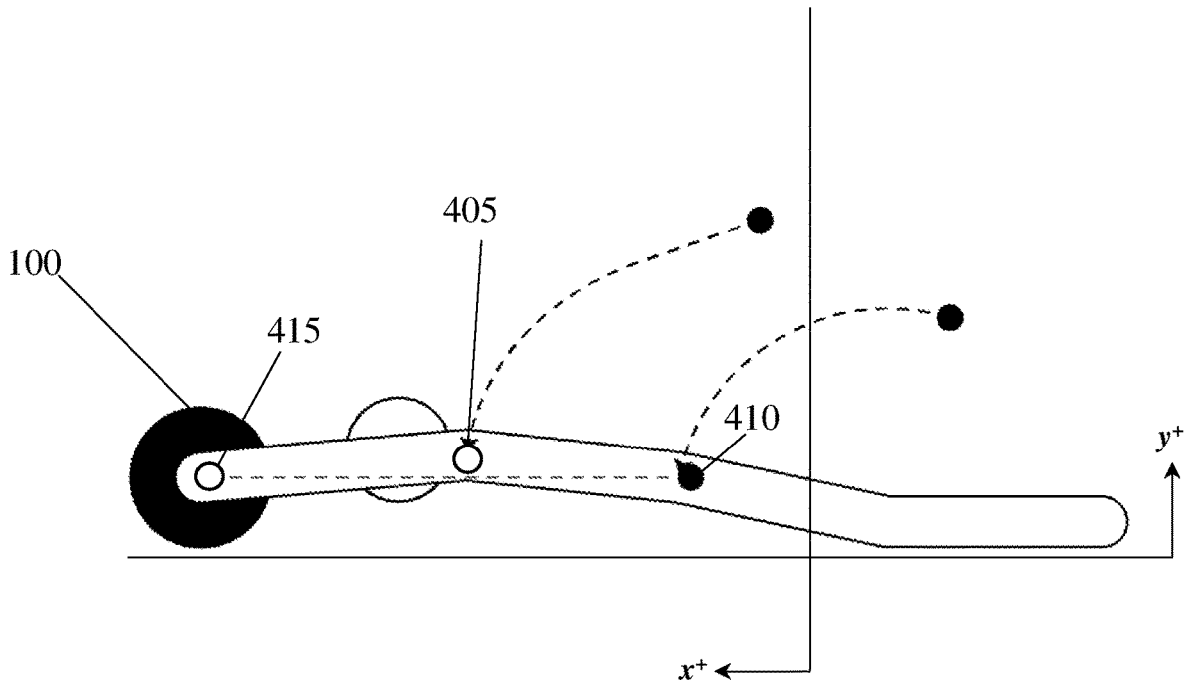
FIG. 6 shows one possibility for the user's form at full extension. This is the animation generated by numerically simulating an actual exercise using the fitness wheel according to an embodiment.
Figure 7:
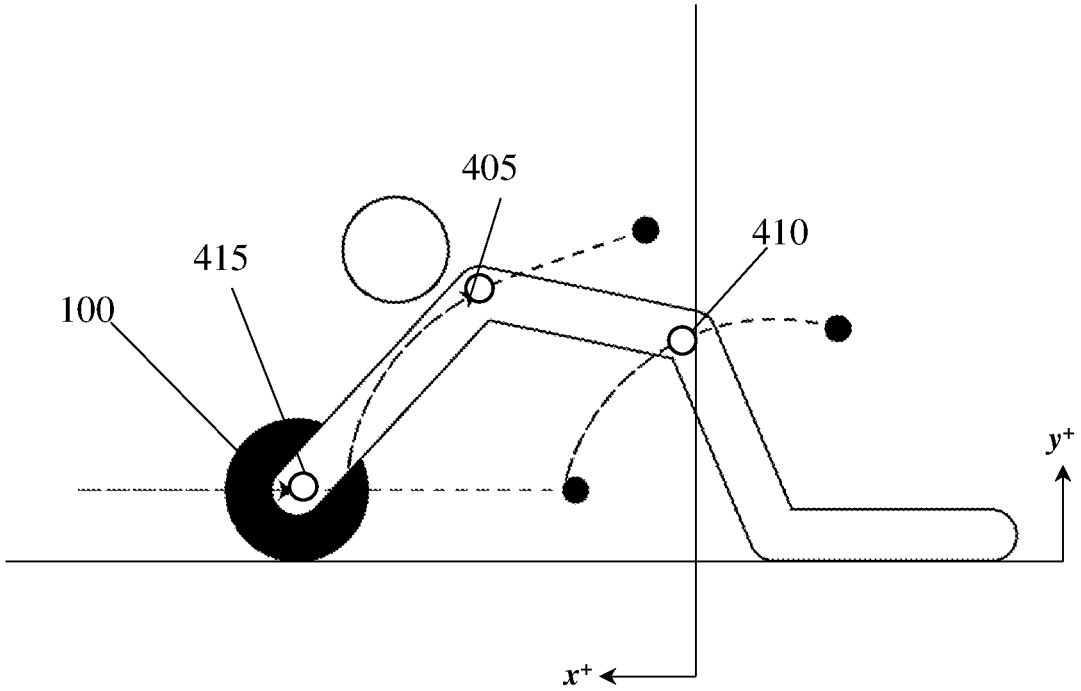
FIG. 7 shows one possibility for the user's form during flexion. This is the animation generated by numerically simulating an actual exercise using the fitness wheel according to an embodiment.
Figure 8:
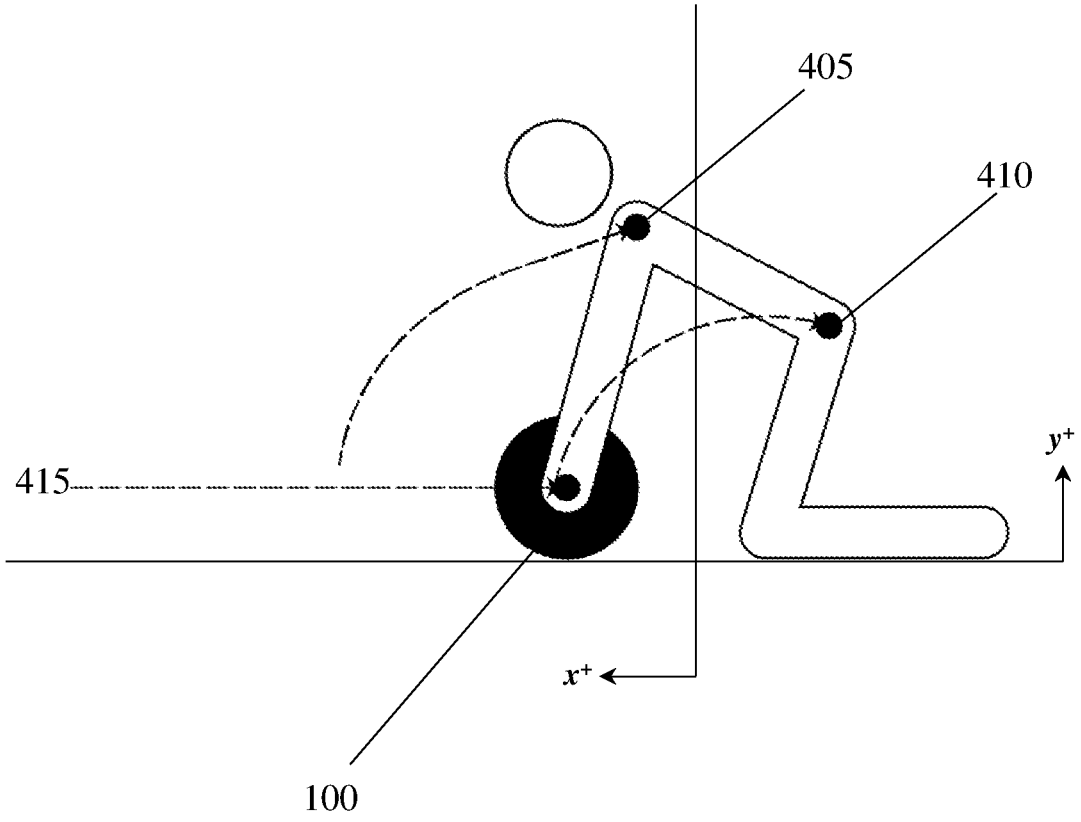
FIG. 8 shows one possibility for the user's form flexed back to (approximately) starting position. This is the animation generated by numerically simulating an actual exercise using the fitness wheel according to an embodiment.

FIG. 2 is a block diagram illustrating the interconnected and interoperating mechanical, electrical, and software components of the fitness wheel 100, configured to provide real-time, dynamic control of the motorized fitness wheel in response to user actions, according to an embodiment. FIG. 3 is a block diagram showing an exemplary configuration of the electronics of the fitness wheel 100, according to an embodiment.

The fitness wheel 100 provides a unique advantage in that it can provide assistive exercises to beginners and resistive exercises to experts, maximizing the use of any athlete's available time and energy. The fitness wheel 100 is configured such that users can interact with the device both physically, by providing inputs via a physical interface comprising electromechanical hardware (arrow 201) and digitally, by providing inputs via a digital interface (e.g., software application executed on a smart phone, tablet, personal computer, etc.) (arrow 202). Both types of inputs can be received and processed using a microcontroller 210 and used to define the type and the difficulty of exercise, often given by the user's strength, fitness, and/or experience level. For example, a user can select a difficulty level using the rotary difficulty selection rotary dial 4, which is received at the microcontroller 210 (arrow 201). Similarly, the user can select a difficulty and/or an exercise type using a smartphone application 250, which is received at the microcontroller (arrow 202) via a wireless communication connection (e.g., Bluetooth). In response to the user inputs sent to the microcontroller onboard the fitness wheel, the microcontroller initiates a motor feedback loop (arrows numbered 203) as a function of the user inputs to control the operation of the fitness wheel and thereby facilitate the exercise. In an embodiment, the motor-feedback loop subsystem is configured to operate as follows: sensors 215 measure and relay real-time current data measured from the motor to the microcontroller 210; microcontroller 210 computes the torque-generating portion of the current and identifies any discrepancy between measured and target torque-generating currents; microcontroller 210 generates corrective information as a function of the discrepancy, which is sent as a new voltage command (as a duty cycle) to the motor electronics 220 which drive the motor 9. As further described herein (see § 2.4.2), the "target" torque output is dependent on certain data, derived from the aforementioned user inputs, among other parameters. Simultaneously, a battery management loop (arrow 204) is provided to ensure that battery voltage is managed appropriately including indicating to the user when the battery needs charging. Alternatively, battery management electronics 230 may control the battery without any additional software input from the microcontroller 210. In an embodiment, the battery 240, which can comprise a single or multiple battery units referred to herein simply as a "battery", is managed by electronics: the microcontroller 210 reads the battery voltage for control, and the battery manager/electronics 230 charges the battery whenever it is plugged in for charging and the battery need to be charged. The battery supplies voltage and current to the electronics 220. As shown in FIG. 2, the microcontroller 210 can also be configured to output information to the digital interface of the user (arrow 206), for instance, via the on-board user interface including the rim-mounted LEDs 2, or via a physical interface (arrow 205) such as the difficulty display 3.

§ 2.2 Mechanical

§ 2.2.1 Internal Mechanism

In an embodiment, the fitness wheel 100 comprises an outrunner motor 9 in which the stator is the hub of the motor, and the rotor (the moving portion) is on the outside, surrounding the stator. The windings of the motor are connected to a motor drive (not shown) that energizes the motor. Although the illustrated embodiment of FIG. 1B shows a motor 9 directly coupled to the rotating portion of the wheel 1, this is exemplary and non-limiting as it should be understood that the motor can be coupled to the wheel through a suitable transmission (e.g., gears, belts, etc.).

§ 2.2.2 External Interface

In an embodiment, the physical user interface elements 255 are located on the hubcap 8, on one side of the fitness wheel. Various features and functionality of the fitness wheel 100 are controlled by the microcontroller 210 as a function of user inputs provided using the physical tactile elements of the interface 255, including, the difficulty selection rotary dial 4, Bluetooth button 5, and power button 6. As would be understood, the Bluetooth button causes the fitness wheel 100 to connect via a wireless communication interface (e.g., Bluetooth) to remote devices such as a user's smartphone. An exercise digital interface application can be running on the smartphone allowing the user to interact with the fitness wheel 100 via the smartphone.

In one embodiment, the microcontroller 210 is configured to display a value representing the selected exercise difficulty on the difficulty display 3. As shown, the difficulty display 3 can comprise a range of numbers on the fitness wheel hubcap (displayed as: 5 4 3 2 1 0 1 2 3 4 5). For instance, when a difficulty is selected using the selection rotary dial 4, the selected number can be illuminated by the microcontroller in either red (to the left of zero, signifying hard difficulty) or green (to the right of zero, signifying easy difficulty). Although the power function can be automatically controlled via a software application, a mechanical power button 6 can be provided to give the user control and confidence of the status of the fitness wheel 100. In an embodiment, Bluetooth control button 5 is provided as a separate button to avoid unwanted power cycling, instead of consolidating Bluetooth into the power button for dual functionality. In an embodiment, the Bluetooth button can be eliminated, relying on Bluetooth Low Energy (BLE) to allow portable devices to establish a connection to the fitness wheel. This feature would be particularly beneficial in a public gym, personal training or physical therapy facility because users could walk up to the fitness wheel and quickly establish communications with it.

Other elements of the interface 255 can include: visual state communication devices (LEDs 2 on wheel rim), and haptic feedback (motor control signals causing motion that users can feel on the handles). Another interactive user interface element can include the exercise digital interface 250 (i.e., the smartphone application) executing on the user's smartphone and configured to wirelessly send user inputs and control commands to the microcontroller 210.

The wheel rim mounted LEDs 2 can be controlled by the microcontroller 210 to communicate information concerning different states of the wheel (e.g., low battery, completed repetition, Bluetooth connection status, etc.) to the user through different colors, patterns, and animations (see e.g., Table 1, below).

TABLE 1

| LED Feedback | | | | |
|---|---|---|---|---|
| Name | Feedback Type | Interface | Description | Recomm. Requirements |
| Battery Low | Passive | LED | Pulse RED | No App |
| Charger Plugged In | Passive | LED | Solid RED | No App |
| Battery Full | Passive | LED | Pulse GREEN | No App |
| Difficulty | Passive/Active | LED/Phone | Solid | No App |
| Selection | Discrete | App | GREEN/RED | |
| Bluetooth Pairing | Passive | LED | Pulse BLUE | App |
| Bluetooth Connected | Passive | LED | Sweep BLUE | App |
| Event (e.g., max distance, stop point) | Active Continuous | LED | Glow GREEN | App |
| Last Repetition | Active Continuous | LED | Pulse YELLOW | App |

| Legend | |
|---|---|
| Feedback Types | Description LED Patterns |
| Passive<br>Occurs outside of the exercise<br>Active Continuous<br>Occurs continuously throughout the entirety of the exercise/workout<br>Active Discrete<br>Occurs between each repetition, set, exercise, or workout | Pulse<br>Full rim oscillates on and off smoothly for a prescribed amount of time<br>Solid<br>Full rim turns on smoothly and stays on for a prescribed amount of time<br>Sweep<br>Rim lights up and turn off section-by-section<br>Glow<br>Full rim turns on smoothly and stays on until user reacts |

In an embodiment, the LEDs 2 are specifically placed on the rim of the wheel to maximize their presence in the field of view of the user. In an embodiment, as further describe herein, the fitness wheel can be configured to provide haptic feedback via the "flutter" command (see § 2.4.2.4) to designate wheel states. In an embodiment, the smartphone application 250 can also be configured to operate in tandem with the fitness wheel as a digital interface to communicate exercise progress as well as health statistics in greater detail.

§ 2.3 Electrical

In an embodiment, two circuit boards contain the electronics on-board the fitness wheel 100 for controlling its operation. It is well understood that the two boards can be combined into one or split into more than two for any reason including improved packaging or cost reduction.

§ 2.3.1 Microcontroller

As shown in FIG. 3, and as explained above, in an embodiment, the microcontroller 210 receives user inputs via the selection dial (arrow 301) and digital interface 250 (arrow 302) and controls operation of the fitness wheel accordingly. Similarly, the microcontroller can be configured to output information relating to the operation of the fitness wheel via the LEDs 2 (arrow 305) and digital interface 250 (arrow 306).

The microcontroller 210, connected to the motor 9, is configured to control the motor torque during the exercise. Reference to "microcontroller" in this document can refer to either a) a single microcontroller or microprocessor performing one or more of the functions; b) multiple microcontrollers or microprocessors performing various functions in unison or; c) a mix of microcontrollers or microprocessors performing various functions in unison. It should also be understood that reference to microcontroller can encompass other types of custom or preprogrammed logic device, circuit, or processor, such as a programmable logic controller (PLC), computer, software, or other circuit (e.g., ASIC, FPGA) configured by code or logic to carry out their assigned task.

As shown in FIG. 3, in an embodiment, the microcontroller 210 is part of a motor drive circuit identified by connections labeled 304. More specifically, a motor controller module 214 of the microcontroller controls a 2 or 3-phase bridge, which controls voltages/currents provided to a brushed or brushless motor 9. A brushless motor can be preferred for smoother operation. The motor drive circuit also includes a feedback loop. As the user exercises with the fitness wheel, the feedback loop comprising a combination of sensors (e.g., hall sensors, magnetic sensors, current sensors, and an encoder) relays motor position and current data to the control microcontroller unit 210. In an embodiment, the feedback loop of the motor drive circuit can comprise current sensors with signal conditioning, 270. This feedback loop is put in place to ensure the motor is following the correct torque profile along the exercise path.

§ 2.3.2 Batteries, Battery Management Chip

In the preferred embodiment, the electronics are powered by a battery 240 that is managed by battery management electronic components (230, FIG. 2). In an embodiment microcontroller 210 comprises two microprocessor units, the motor controller 214 and a supervisor controller 212. The supervisor controller 212 communicates with the motor controller 214 and peripheral devices including user interface devices among other electronic hardware components (e.g., LED driver 280, for driving the LEDs 2).

In an embodiment, the motor controller 214 manages control of the device's Brushless DC (BLDC) motor 9. In addition, the motor controller utilizes a gate drive and a 3-phase bridge 260 to control a brushless three-phase motor 9. The supervisor 212 controller processes user-input from peripherals such as rotary dials 4 or inputs received over Bluetooth from the smartphone application 250. In some embodiments, the supervisor controller 212 communicates with the motor controller over a bus (such as an SPI bus) which will communicate information such as requested state changes or exercise measurements. Note that this architecture is an example, however, many related alternatives are possible, for example, one MCU can be used for both motor control and user interface, and different motor types (induction, brushed DC, variable reluctance, etc.) can be used without departing from the scope of the disclosure.

To properly control the motor 9, one or more sensors (e.g., sensors 215, FIG. 2; sensors 270, 275. FIG. 3) can be used to collect information for the microcontroller 210 and its software concerning one or more movement variables. The information measured by the sensors and used by the microcontroller to control the motor can include positional information, which represent spatial and/or temporal variables concerning the movement of the fitness wheel 100 (e.g., displacement, velocity, acceleration, and the like). For example, in an embodiment, position sensor 275 can comprise a rotary encoder used to measure the angle of the motor 9. In an embodiment, position sensor 275 can comprise a hall effect or magnetic sensor to measure the angle of the motor within a phase. From this position information, the motor's angle, speed (revolutions over time), and acceleration (e.g., rate of change of speed) can be computed by the motor controller 214 for use in commutating the motor and controlling the exercise. It should be understood that, in addition or alternatively, hall effect sensors, magnetic sensors, or any other suitable positional feedback sensor can be used for this function. It should be understood that reference to a position sensor is not limited to a sensor device and can include an estimator configured to estimate a given variable based on other measured information. The information collected by the sensors and used to control the motor can also include motor output variables such as torque. Sensors usable for measuring torque output can include, for example, current sensors (e.g., sensors 270) configured to measure torque-producing current of the motor which is representative of the torque output.

§ 2.3.3 Power Electronics

In an embodiment, as shown in FIG. 3, the microcontroller 210, particularly the motor controller 214, can use pulse-width-modulation (PWM) peripherals to send switching commands to a three-phase inverter comprising three half-bridges 260 using Field Effect Transistors (FETs, not shown). The inverter modulates the electrical voltages to the motor to control it.

§ 2.4 Software

In the motor feedback loop (connections 203 of FIG. 2 and connections 304 of FIG. 3), software executing in the microcontroller 210, particularly, the motor controller 214, configures the microcontroller 210 to generate a "target" torque command (which might be expressed as a fraction of torque-producing current). The torque command controls the output torque of the motor drive, thus defining the exercise experience for the user. By defining torque as a function of certain variables (see § 2.4.2.2), the resulting characteristic motor responses serve to challenge the user to exercise in different ways.

§ 2.4.1 Motor Control

In an embodiment, the output torque ($\tau$) of a brushed DC motor drive can be expressed as follows:

$$\tau = I_a k_T, \qquad \text{Eqn. 1.1}$$

where $I_a$ is the armature current and $k_T$ is the torque constant (motor-dependent). In the case of vector control of a three-phase motor, $I_a$ is the torque producing component of the DQ-current ($I_q$). It is important to note that the magnitude of $I_a$ in Equation 1.1 is bounded, such that:

$$\tau_{max} = I_{a,max} k_T,$$

$$\tau_{min} = -I_{a,max} k_T, \qquad \text{Eqn. 1.2.1-2}$$

where $I_{a,\,max}$ is the maximum operating torque-producing current, dependent on the limitations of motor 9, electronics 220, and battery 240. Since the magnitude $I_a$ may not exceed $I_{a,\,max}$ or $-I_{a,\,max}$, $I_a$ will always be a fraction of $I_{a,\,max}$, shown by the following relationship:

$$I_a^* = \frac{I_a}{I_{a,max}} \text{ s.t. } I_a^* \in [-1, 1]. \qquad \text{Eqn. 1.3}$$

Defining torque-producing current in a nondimensionalized form ($I^*_a$), and manipulating that variable, allows for increased utilization of the precision of the number representation used in Microcontroller/Software 210. By controlling the motor using a D-Q formulation [1], the motor controller 214 can command motor torque by commanding the $I_q$ component of the current (set $I_q \rightarrow I_a$). The angular sensor (encoder, hall effect, or magnetic, etc.) is used to compute the D and Q directions and align the currents.

§ 2.4.2 Structure

In an embodiment, the different algorithms for controlling the motor 9 are organized to aid in the development and implementation of programmed exercises through selective combination of various algorithms. "Exercises" are most general and are defined by information such as (but not limited to):

1. The user's "form" or sequence of motions as determined from one or more measured parameters: how far out and back the user moves the wheel; whether the motion is forward-back or to one side or the other; is the user on his/her knees or standing, etc.
2. The "trajectory"—which in the context of this disclosure refers to the torque command (or current) in the exercise wheel. Note that the torque trajectory is not necessarily static—wheel torques might and usually do vary with respect to one or more spatial/temporal variables including, for example, displacement, velocity, time and the like. The trajectory (the torque curve during the rep) is constructed from one or more "profiles" and "events". The trajectory is usually implemented algorithmically—by combining parameters with profile equations and conditions measured by the wheel. As a non-limiting example, a trajectory can be represented in the form of a table of numbers, one or more parameterized equations, and the like, or a combination of the foregoing.
   a. A "profile" is a function (also referred to as a "curve") that relates torque to a measured parameter such as speed or position or time. For example, a linear spring could be represented as a profile—the torque is a function of distance from a home position. The trajectory can be one continuous profile or stitched together from a series of profiles, for example, a linear spring for some distance (a first profile), followed by a nonlinear spring for another distance (a second profile). As a non-limiting example, a profile can be represented in the form of a table of numbers, one or more parameterized equations, and the like, or a combination of the foregoing b. An "event" is a torque or profile change triggered by some condition. For example, a boost in torque to help assist a user to return to home position would be an event. Also, transitions between profiles (to avoid sudden torque changes) would be events. Events may be used to convey information to the user (for example a tactile flutter). Events may be juxtaposed with profiles or other events, or superposed on a profile. For example, tactile flutter (§ 2.4.2.4) may be superposed on a profile.

These and other algorithms for controlling the motor can be stored in a non-transitory computer readable storage medium (not shown) that is accessible to the microcontroller to enable execution during use. In an embodiment, the digital interface 250 can also be configured to store exercises, trajectories, profiles, events and other such motor control algorithms and provide selected algorithms to the microcontroller for local storage and implementation.

The user's form plays a critical role in dictating what muscle groups receive activity throughout the exercise, independent of trajectory and events. In an embodiment, training software matches the trajectory to a proposed user's form (movement) so the user can perform the recommended exercise (usually by doing "reps").

§ 2.4.2.1 User's Form

Following is a discussion of user form and how form factors into the motor control.

For purposes of illustration, a computer simulation of the fitness wheel 100 and user was used to generate a "tin man" exercise simulation and an animation depicted in FIGS. 4-8. The representative body part lengths, masses and joint angles correspond to an actual human subject. Visual targets were mounted on a test subject while using the exercise wheel and the subject was recorded with a camera. The joint angles used in the simulation were obtained from analysis of a video of the human-subject performing the exercise. FIG. 4 through FIG. 8 show the position of the user in a 3-D animation created by performing a simulation of the exercise with the joint angles based on the above-mentioned video analysis. Also shown in dashed lines in FIGS. 4-8 are the paths of the user's hips and shoulders and the wheel center during the exercise.

If the fitness wheel 100 is inactive, the muscle generated torques working at the subject's shoulder and hip, and wrist joints 405, 410, 415 during exercise result mainly from resisting the pull of gravity. During exercise these torques vary with the user's form. Further, if the fitness wheel is active, the working torques appearing at the subject's joints can be altered by the fitness wheel. The fitness wheel can either assist or hinder (resist) the motion of the user.

Muscles can only generate tension in tendons, i.e., they can only pull. In the body, different muscles groups are arranged antagonistically to generate the positive and negative torques working at the subject's joints. Thus, when the sign of the torque changes from positive to negative, the predominate muscle groups being used change, e.g., from back muscles to abdominal muscles as the exercise starts.

Figure 9:
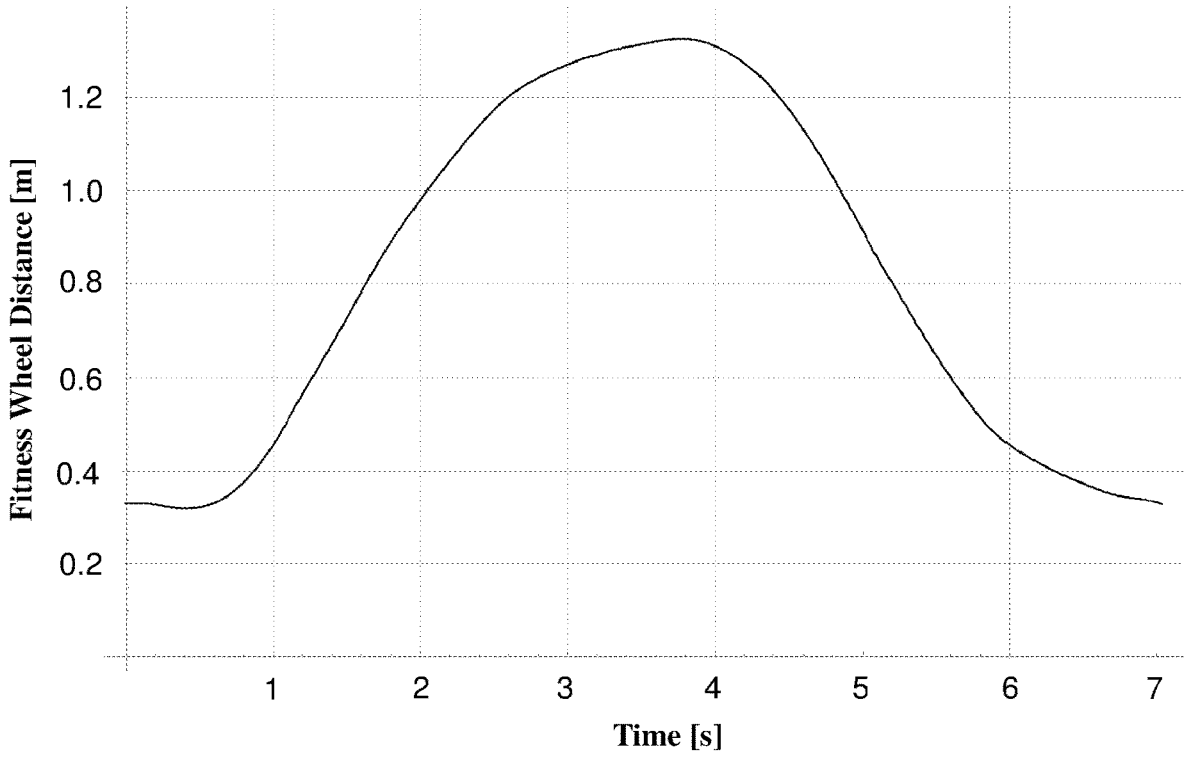
FIG. 9 shows an example of fitness wheel displacement, in the x-direction, during exercise as generated in the simulation shown in the FIG. 4 through FIG. 8, according to an embodiment.

The displacement (d) of the fitness wheel center during exercise is plotted in the FIG. 9. This plot can be used to correlate the position of the wheel (and the user's form) during the exercise.

Figure 10:
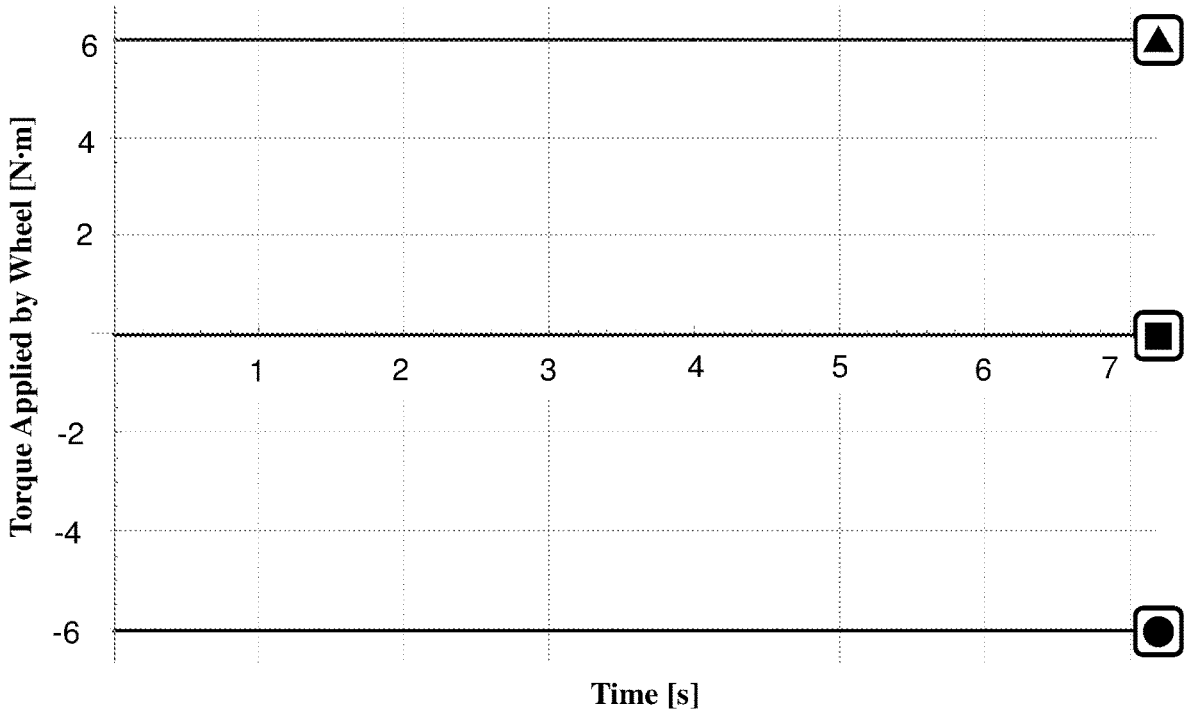
FIG. 10 shows an example of torque applied by the simulated fitness wheel for three cases: (1) no-assist, 0 N·m, (2) maximum-assistance, −6 N·m, (3) maximum-hinderance, +6 N·m, during exercise as inputs to the simulation shown in the FIG. 4 through FIG. 8, according to an embodiment.

As an example, the torques ($\tau$) that the fitness wheel motor can apply to the wheel are plotted in FIG. 10. Specifically, FIG. 10 illustrates torque applied by the simulated fitness wheel for three cases: (1) no-assist, 0 Nm (represented by a square), (2) maximum-assistance, −6 Nm (represented by a circle), (3) maximum-hinderance, +6 Nm (represented by a triangle). Note that the applied torque also appears, with opposite sign, as a torque at the user's wrists. Further, while the example shows a constant torque being applied, it should also be noted that, during exercise, the torque applied by the fitness wheel 100 under control of the microcontroller 210, can vary anywhere between the maximum-assistance and the maximum-hinderance values.

If the fitness wheel 100 is inactive, the motor applies 0 N·m torque, otherwise the motor can apply anywhere between positive full torque and negative full torque. In an embodiment, the maximum torque is between 6 and 16 N·m. In the simulations shown herein, the maximum torque was chosen to be only 6 N·m, therefore the torques in the plots range from +6 N·m and −6 N·m torque, depending on programming. The applied torque of the motor results in an opposing reaction torque at the fitness wheel handgrips of −6 N·m and +6 N·m respectively. In addition to the reaction torque, a horizontal force is generated at the wheel-floor interface, e.g., Fx=(−6 N·m/Radius_of_wheel). The horizontal force also appears at the fitness wheel handgrips and acts on the subject.

Both the torque and the force at the fitness wheel handgrips alter the joint torque to be generated by the various muscle groups. Changing the radius of the wheel, changes the proportion between force and torque at the handgrip. A smaller radius gives a larger magnitude force for the same torque.

Figure 11:
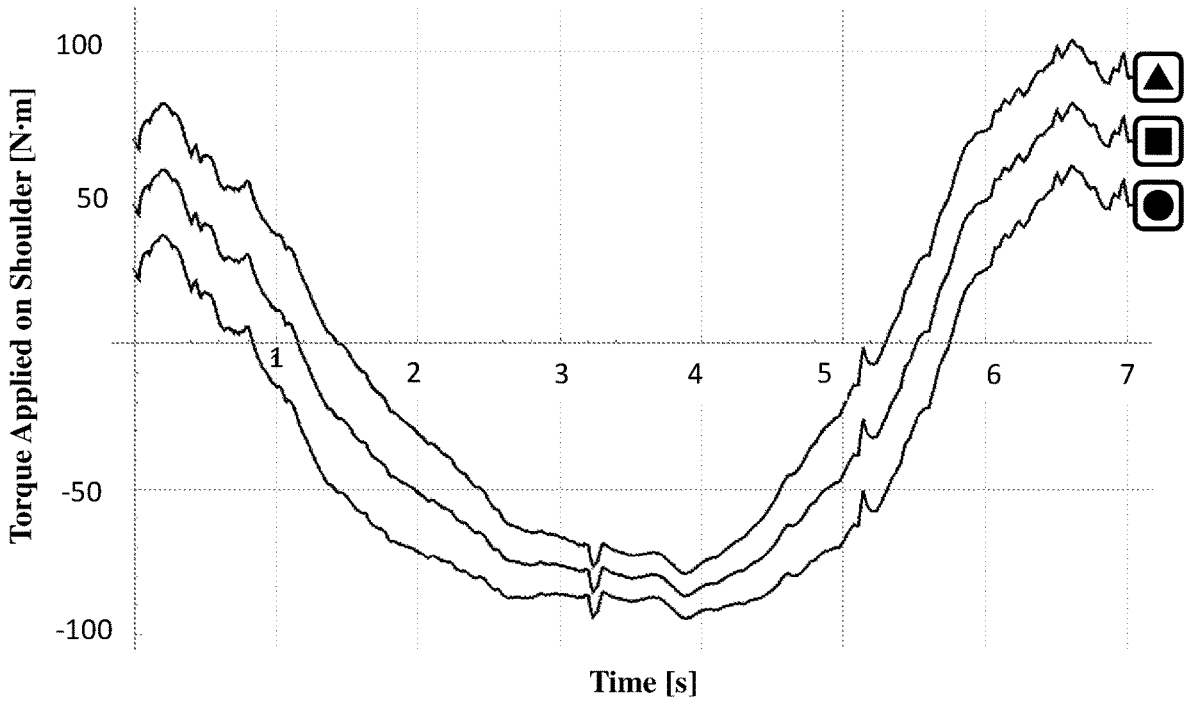
FIG. 11 shows an example of shoulder torque during an exercise for three cases: (1) no-assist, (2) maximum-assistance, (3) maximum-resistance, during exercise as generated in the simulation shown in FIG. 4 through FIG. 8 using the fitness wheel according to an embodiment.

FIG. 11 plots the shoulder joint torque to be generated by the muscle groups during the simulated exercise. Three curves are plotted, the middle curve is for 0 N·m applied motor torque, the lower curve is for −6 N·m applied motor torque, and the upper curve is for +6 N·m applied motor torque. For this simulation, the wheel radius was set to 4 inches (8-inch diameter).

As the curves cross the zero-torque level, the predominate muscle-group changes from back muscles to abdominal muscles. Thus, at the beginning and end of the exercise, the motor torque can be adjusted to modify the exercise for the back muscles, while during the middle of the exercise the motor torque can be adjusted to modify the exercise for the abdominal muscles.

Many different modifications are possible by the microcontroller 210 selectively adjusting the motor torque. At the extremes of the exercise cycle (i.e., when the back muscles are the predominate muscle-group), back muscle exercise could be minimized or maximized, and separately but during the same exercise sequence, abdominal muscle exercise could be maximized or minimized during the middle phase of the exercise (i.e., when the abdominal muscles are the predominate muscle-group).

As can be appreciated, minimizing both the back muscle and abdominal muscles exercise would make the exercise easier (or perhaps even possible) for a novice. Maximizing both the back muscle and abdominal muscles exercise would make the exercise most challenging and beneficial for a seasoned user. Minimizing back muscle exercise alone would be beneficial for users with sensitive back muscles.

In addition to minimizing or maximizing, in an embodiment, the working joint torque could be "leveled." More specifically, the microcontroller 210 can be configured to selectively adjust the motor torque such that the working joint torque is kept as close as possible to a set level that challenged a given user. Thus, the user would get as much benefit as possible from each cycle of exercise.

Figure 12:
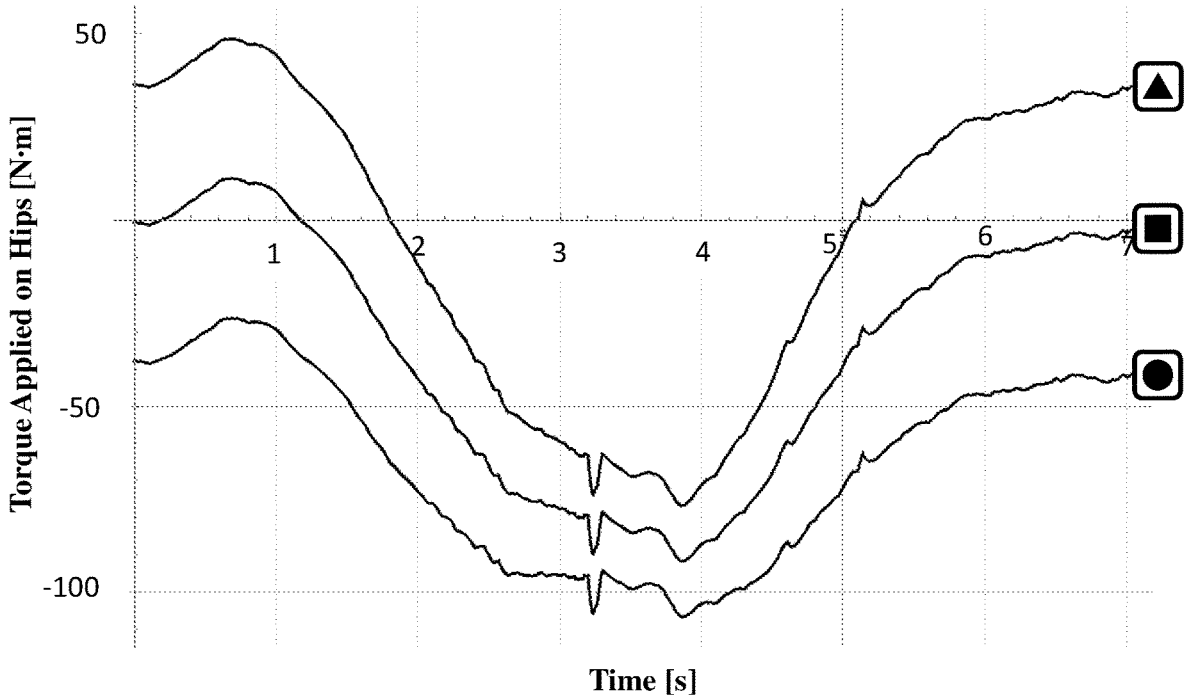
FIG. 12 shows an example of hip torque during exercise for three cases: (1) no-assist, (2) maximum-assistance, (3) maximum-resistance, during exercise as generated in the simulation shown in FIG. 4 through FIG. 8 using the fitness wheel according to an embodiment.

FIG. 12 plots the hip joint torque to be generated by the muscle groups during the simulated exercise. Three curves are plotted, the middle curve is for 0 N·m applied motor torque, the lower curve is for −6 N·m applied motor torque, and the upper curve is for +6 N·m applied motor torque.

In addition to being minimized, maximized, and leveled (as the working hip joint torques), the working shoulder joint torques could be used as constraints to limit stress on the muscle groups associated with the positive and negative working-shoulder-joint torques.

Generalizing, the microcontroller 210 can be configured to selectively adjust the motor torque such that the hip, shoulder, and wrist working joint torques could be kept within limits, while optimizing the benefit of the exercise for a given user.

Human subjects tend to adjust to a given biomechanical task such that their muscular energy expenditure is minimized. This adjustment takes some time, so it is anticipated that users will need an adjustment period as programmatic changes are made.

§ 2.4.2.2 Profiles

Profiles are the building blocks of torque trajectories, which the fitness wheel 100 follows throughout the exercise. Broadly, profiles can define the torque applied by the motor 9 as a function of movement variable data, which can include data determined by position (e.g., displacement, velocity, etc.), or data determined by time.

Profiles can include spatial profiles which define torque-producing current of the motor and thus its torque output as a function of the position of the wheel. As noted above, wheel position input data can be measured using a position sensor(s) (e.g., 275). In an embodiment, wheel position input data can be differentiated (m-times) with respect to time, and that resulting quantity can be raised to a power (n) to yield different torque curve variants. An overall gain factor (a) is applied to scale the torque curve, resulting in a family of strengths for a given characteristic torque curve:

$$I_a^* = \alpha \operatorname{sgn}\left(\frac{d^m}{dt^m}(x)\right)\left|\left[\frac{d^m}{dt^m}(x)\right]^*\right|^n,\ \alpha \in \mathbb{Q}_{[-1,1]},\ n, m \in \mathbb{Q}_{\geq 0} \qquad \text{Eqn. 2.1}$$

Equation 2.1 can be expanded to more rigorously show the variables and calculations necessary to yield the appropriate torque-producing current—and therefore output torque—to be commanded (Equation 2.2).

$$\frac{I_a}{I_{a,max}} = \alpha \operatorname{sgn}\left(\frac{d^m}{dt^m}(x)\right)\left|\frac{\left[\frac{d^m}{dt^m}(x)\right]}{\left[\frac{d^m}{dt^m}(x)\right]_{max}}\right|^n = \beta(\alpha, x) \qquad \text{Eqn. 2.2}$$

The "max" term in the denominator is determined experimentally. While the numerator in Equation 2.2 is based on sensor data measured throughout the exercise, the denominator (e.g., maximum position, maximum velocity, etc.) is preferably prescribed before the exercise is initiated. There are two main methods for providing this information to the microcontroller 210 software: it can be entered manually (or indirectly computed from a manual entry) by the user though the user interfaces (e.g., via the digital interface 250 or physical interface 255 on the fitness wheel 100); and/or programmed in the microcontroller as a default (e.g. maximum position obtained from average human rollout distance, maximum velocity obtained from safest exercise speed, etc.). Data can be collected automatically while the wheel is in use and an upper limit for that term is determined.

Each characteristic torque curve (defined by constants m and n) is represented by a function $\beta(\alpha, x)$, where position (x) drives the curve and the scaling factor (a) amplifies the curve. The dimensionless value from the function $\beta(\alpha, x)$ is scaled by the motor-specific maximum torque-producing current $I_{a,\ max}$ a constant, to yield the desired torque-producing current in physical units $I_q(\alpha, x)$:

$$I_q(\alpha,x)=\beta(\alpha,x)I_{a,max}. \qquad \text{Eqn. 2.3}$$

In an embodiment, the curves generated using the above formulation can be designed to mimic physical phenomena. The following Table 2 describes three example spatial profiles, their respective variables, and governing equations. In the examples in the table below, the profiles are configured to mimic the characteristics of springs and dampers. The scaling factor ($\alpha$) is shown to represent a spring constant (k) and a damping constant (c), which are also limited to the interval [−1,1].

TABLE 2

Example Position-dependent Profiles (in positive-x direction)

| Example Profiles | Variables | Governing Equation |
|---|---|---|
| Linear Spring<br>Mimics experience of using an existing linear torsion spring ab wheel | $\alpha = -k$<br>$m = 0$<br>$n = 1$<br>$I_{a,\ max}$ is motor dependent<br>$x_{max}$ is user dependent | $F = -kx$<br>$I_a = -I_{a,max}\left[\alpha\left\lvert\frac{x}{x_{max}}\right\rvert\right]$ |
| Quadratic Spring<br>Can be used to increase the relative magnitude of torque at the end of the rollout | $\alpha = -k$<br>$m = 0$<br>$n = 2$<br>$I_{a,\ max}$ is motor dependent<br>$x_{max}$ is user dependent | $F = -kx^2$<br>$I_a = -I_{a,max}\left[\alpha\left\lvert\frac{x}{x_{max}}\right\rvert^2\right]$ |
| Damper<br>Resistance increases with rollout speed; challenges users as they build speed and exercise confidence | $\alpha = -c$<br>$m = 1$<br>$n = 1$<br>$I_{a,\ max}$ is motor dependent<br>$v_{max}$ is manually decided | $F = -c\dot{x} = -cv$<br>$I_a = -I_{a,max}\left[\alpha\left\lvert\frac{v}{v_{max}}\right\rvert\right]$ |

Similar to the position-based profiles, a set of time-based profiles can be created by defining torque-producing current as a function of time:

$$I_a^*=\alpha(t^*)^n, \alpha \in \mathbb{Q}_{[-1,1]}, n \in \mathbb{Q}_{\geq 0} \qquad \text{Eqn. 3.1}$$

Equation 3.1 can be expanded and rearranged to solve for the torque-producing current ($I_a$) as a fraction of the maximum capable torque-producing current ($I_{a,\ max}$) for a given motor:

$$\frac{I_a}{I_{a,max}} = \alpha\left(\frac{t}{T}\right)^n = \gamma(\alpha, t) \qquad \text{Eqn. 3.2}$$

with time period, T, and exponent, n. Configuring the constants ($\tau$, n) in Equation 3.2 changes the characteristic of the resulting torque curve. Each characteristic torque curve is represented by a function $\gamma(\alpha, t)$, where time (t) drives the curve and the scaling factor ($\alpha$) amplifies the curve. Similar to spatial profiles, the dimensionless function $\gamma(\alpha, t)$ is scaled by the maximum torque-producing current of the motor, $I_{a,\ max}$, a constant (Equation 3.3). The result $I_q(\alpha, t)$ is the desired torque-producing current in physical units $I_q(\alpha, x)$.

$$I_q(\alpha,t)=\gamma(\alpha,t)I_{a,max} \quad \text{Eqn. 3.3}$$

Temporal profiles (torque as a function of time) can be applied, for example, in situations where the user is to be guided through an exercise at a predetermined pace.

§ 2.4.2.3 Trajectories

The human body is made up of a complex system of muscles. Sometimes, a simple torque profile relationship is not optimized for consistent muscle activity throughout the exercises as motivated by section 2.4.2.1 above. Other times, a torque profile might prevent a desired exercise experience from being realized. Thus, in an embodiment, multiple torque profiles (and/or events) can be combined to optimize an exercise for a user. Trajectories constructed from combining torque profiles and events can be preprogrammed into the microcontroller 210 or sent to the microcontroller from the digital interface 250.

In an embodiment, the microcontroller 210 can be configured to use a linear combination of the aforementioned torque profiles to construct new, complex profiles through the use of a weighting function:

$$I_{a,total} = \sum_{i=1}^{k} w_i I_{a,i},\ k \in \mathbb{Z}_{>1},\ \text{s.t. } I_{a,total} \in [-1, 1] \quad \text{Eqn. 4}$$

where $I_{a,\ total}$ is the total combined torque-producing current, $w_i$ is each weight, and $I_{a,\ i}$ is each profile-specific torque-producing current. The weights can be a combination of positive and negative values as long as $I_{a,\ total}$ is within the interval [−1, 1]. Overlapping torque profiles in a simultaneous way yields complex torque relationships (FIG. 13), which in some cases provides a smoother exercise experience.

In an embodiment, torque profiles can be further combined in a piecewise manner, such that certain aspects of an exercise path are given different characteristics. For example, a spring model can be used to smoothly ramp up the torque in the first 10% of the rollout, such that the beginning of the reverse damper model profile does not create too much sudden torque for the user.

Humans are adept at sensing small force perturbations, so the feel of the wheel is important. An important aspect of the exercise experience to be achieved by the microcontroller is the development of torque profiles that feel smooth and benefit the exercise. In order to create smooth profiles, the microcontroller 210 is configured to "stitch" together profiles without discontinuities in torque from one profile to the next. It should be understood that the foregoing are example methodologies implemented by the microcontroller to combine torque profiles to create complex trajectories and provide a smooth experience; variations can be used to achieve similar results that would fall within the scope of the disclosed embodiments. It should be understood that, in addition or alternatively, the example steps for generating simple profiles or complex trajectories through combining or adjusting profiles, events, and the like, can be performed by other devices in communication with the microcontroller, such as the digital interface on 250 or another remote computing device in direct or indirect communication with the microcontroller 210.

For example, the following Table 3 describes two example simultaneous combination trajectories, including respective variables, and governing equations.

TABLE 3

| Trajectories (in positive-x direction) | | |
|---|---|---|
| Example Trajectories | Variables | Governing Equation |
| Reverse Damper Assistance decreases with rollout speed; helps users work on range of motion while building exercise confidence | $m_1, m_2 = 1$<br>$n_1 = 1, n_2 = 0$<br>$I_{a,\ max}$ is motor dependent<br>$v_{max}$ is manually decided<br>$w_1 = -1, w_2 = 1$ | $I_{a,1} = -I_{a,\ max}\left[\alpha\left\lvert\frac{v}{v_{max}}\right\rvert\right]$<br>$I_{a,\ 2} = -I_{a,\ max}\alpha$<br>$I_{a,\ total} = w_1 I_{a,\ 1} + w_2 I_{a,\ 2}$<br>$I_{a,total} = I_{a,\ max}\left[\alpha\left(\left\lvert\frac{v}{v_{max}}\right\rvert - 1\right)\right]$ |
| 40% Quadratic Spring, 60% Damper Challenges users as they build speed on the quadratic spring profile | $m_1 = 0, m_2 = 1$<br>$n_1 = 2, n_2 = 1$<br>$I_{a,\ max}$ is motor dependent<br>$x_{max}$ is user dependent<br>$v_{max}$ is manually decided<br>$w_1 = 0.4, w_2 = 0.6$ | $I_{a,1} = -I_{a,\ max}\left[\alpha\left\lvert\frac{x}{x_{max}}\right\rvert^2\right]$<br>$I_{a,2} = -I_{a,\ max}\left[\alpha\left\lvert\frac{v}{v_{max}}\right\rvert\right]$<br>$I_{a,\ total} = w_1 I_{a,\ 1} + w_2 I_{a,\ 2}$<br>$I_{a,total} = -I_{a,\ max}\left[\alpha\left(0.4\left\lvert\frac{x}{x_{max}}\right\rvert^2 + 0.6\left\lvert\frac{v}{v_{max}}\right\rvert\right)\right]$ |

§ 2.4.2.4 Events

As noted, events are specific events, namely, supplemental wheel torque control functions, that are selectively applied by the microcontroller 210 on top of a trajectory in response to the detection of prescribed conditions along the trajectory. Similar to a torque profile, a supplemental torque event (or simply "event") defines a target output torque value as a function of a movement variable such as a spatial variable and/or a temporal variable. However, an event is intended to be applied for a portion of an exercise cycle.

In an embodiment, a boost event for selectively increasing torque can be integrated on top of the original exercise trajectory, say, in situations where the user may need an extra kick of torque to progress along the exercise. Although the fine details of boost implementation can vary dependent on the type of exercise, all boost variations typically share the same characteristics: one or more threshold conditions that are required to initiate the boost; a ramp up of torque from the current torque to a goal boost torque; a ramp down to the original exercise profile.

For example, the microcontroller can be configured to activate the boost event upon determining that the user has passed a certain positional threshold on the outward motion of the exercise, and when the user passes under a prescribed velocity threshold. When both terms have been met, the boost event is applied on top of the basic assistance torque profile. For instance, as shown, the boost event ramps up torque to a goal torque value as the velocity of the wheel approaches zero, which is defined as a function of exercise difficulty. On the way back to the resting position of the exercise, the torque will gradually rejoin the nominal profile. The boost gives the user the feel of an extra push backwards to initiate the return to home position.

Figure 13:
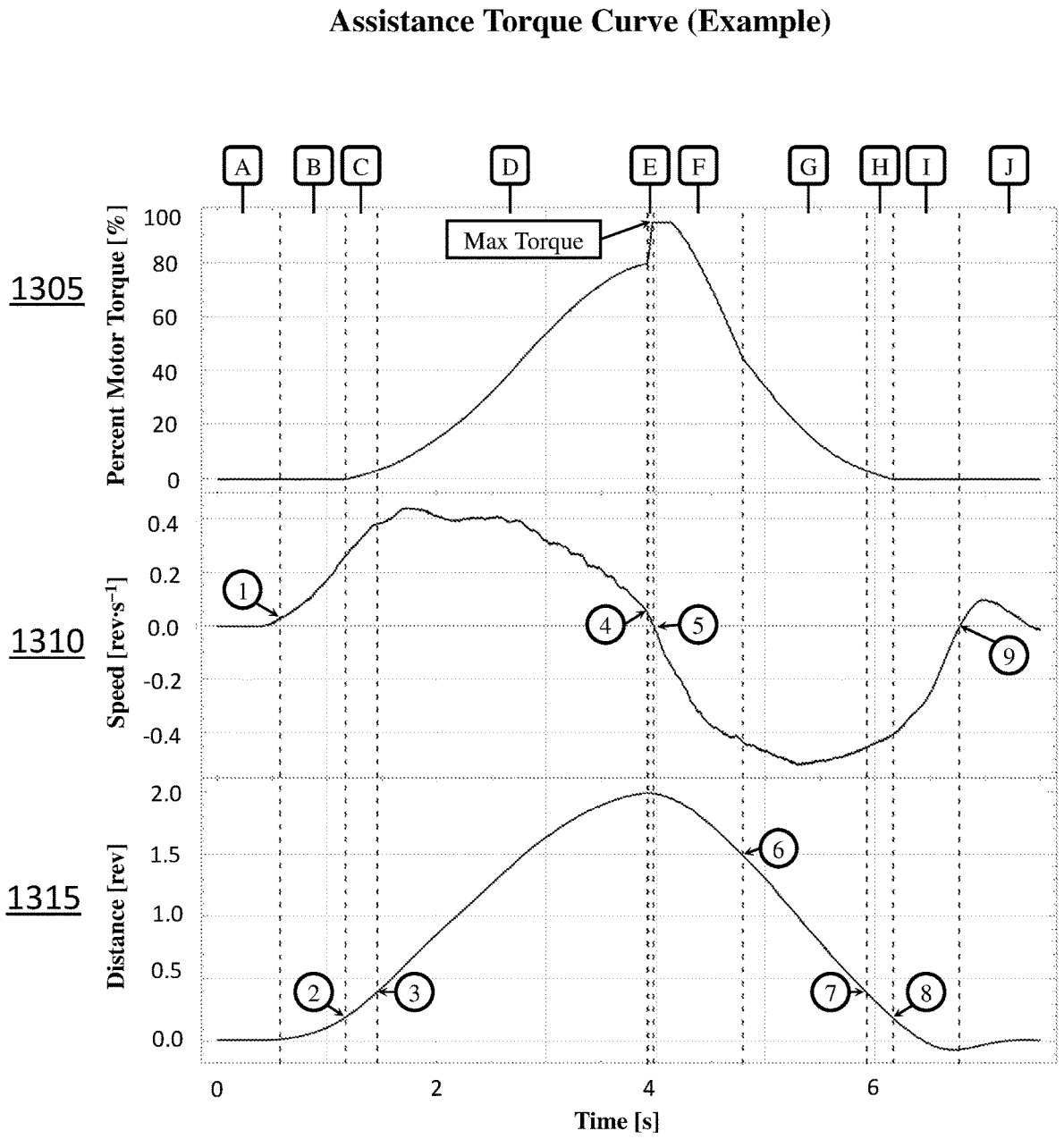
FIG. 13 shows three related graphs illustrating an exemplary assistance motor torque curve, corresponding wheel speed measurements and distance measurements for a cycle of an example exercise, according to an embodiment.

FIG. 13 illustrates three related graphs concerning an example assisted torque trajectory/curve implemented by the fitness wheel 100 in an example full cycle of an exercise. The trajectory comprises a combination of profiles and events. The first graph 1305 illustrates percent motor torque over time, the second graph 1310 illustrates wheel speed over time, and the third graph 1315 illustrates distance covered over time. The wheel speed and distance graphs represent the spatial and temporal variables measured during the performance of the exercise cycle by a user. The percent motor torque graph illustrates the percentage of motor torque that is output in correspondence with the distance and speed curves. Positive torque values in this plot represent torque fighting against positive forward motion of the wheel and assisting return motion (assistance in the exercise). At the top of the first graph 1305 are a sequence of marked modes (A)-(J) that indicate operational modes executed by the microcontroller 210. Mode transition time points in graphs 1310, 1315 are marked as ①-⑨. As shown, the wheel starts in Standby mode (A), in which microcontroller 210 waits for motion. Once the microcontroller 210 detects that the speed of rotation of the wheel exceeds a threshold, say, 0.03 rev/sec in either direction (marked as ① in graph 1310), the microcontroller 210 transitions to "Deadband" mode (B). In Deadband mode, no torque is produced and the microcontroller 210 waits to see how far the wheel is moved. If the user stops movement, the microcontroller 210 transitions back to Standby mode (A) and resets. If the user continues to move in the same direction and passes a position of, for example, 0.2 revs ②, the microcontroller 210 enters Crossover Mode (C). In crossover mode (C), the microcontroller controls motor torque to ramp up linearly as the wheel is moved a prescribed distance, say, from 0.2 revs to 0.4 revs. After the wheel distance passes a position of 0.4 revs ③, the microcontroller 210 enters "Profile" Mode (D). In Profile mode, the microcontroller sets motor torque in terms of a profile, say, a profile that defines torque as a quadratic function of position, (e.g., Torque_Current=overall_gain*quadratic_gain*(position^2)/max_position^2), with overall_gain changing with the mode selected (0.8 in the example shown in FIG. 13), quadratic_gain=1.0, and max_position=2.0 (corresponding to an appropriate value for a tall adult). The quadratic function is followed until the distance traveled is at least a prescribed distance, say, 0.75*max_position=1.5 revs, and simultaneously the speed drops below a threshold, say, 0.05 rev/sec ④. The slowdown signals to the microcontroller 210 that the user is near the end of the exercise and is stretched out. At this point, the microcontroller 210 can bump the torque by a prescribed amount, say, 20% to give the user extra assistance to start backwards and return to the starting position. To accomplish the "Boost", the microcontroller 210 enters Boost Ramp up mode (E) and, for example, linearly increases the torque from its current value to 120% of its current value as a linear function of decreasing velocity from 0.05 rev/s to 0.005 rev/sec. As shown in FIG. 13, at this point the maximum allowable torque is exceeded so the torque is saturated at max. When the wheel speed drops below a set value, for instance, 0.005 rev/sec ⑤, the microcontroller 210 transitions to Boost Ramp Down mode (F). In Boost Ramp Down mode (F), the torque is linearly scaled between the peak value and the "Rejoin" value at which point the wheel motion rejoins the original quadratic torque curve. The rejoin point is set to be 0.75*max_position=1.5 revs ⑥. At this position, the microcontroller 210 transitions back to Profile mode (G), described above. After the wheel position crosses below, for example, 0.4 revs ⑦, the wheel returns to Crossover mode (H), described above. As the wheel position drops below, for example, 0.2 revs ⑧, the wheel transitions back to Deadband mode (I), described above in which the wheel motor outputs no torque. In Deadband mode the microcontroller waits for the speed to drop below, for example, 0.01 rev/sec ⑨ at which point it enters back into Standby mode (J) and resets. This completes one full cycle of the exercise.

Figure 14:
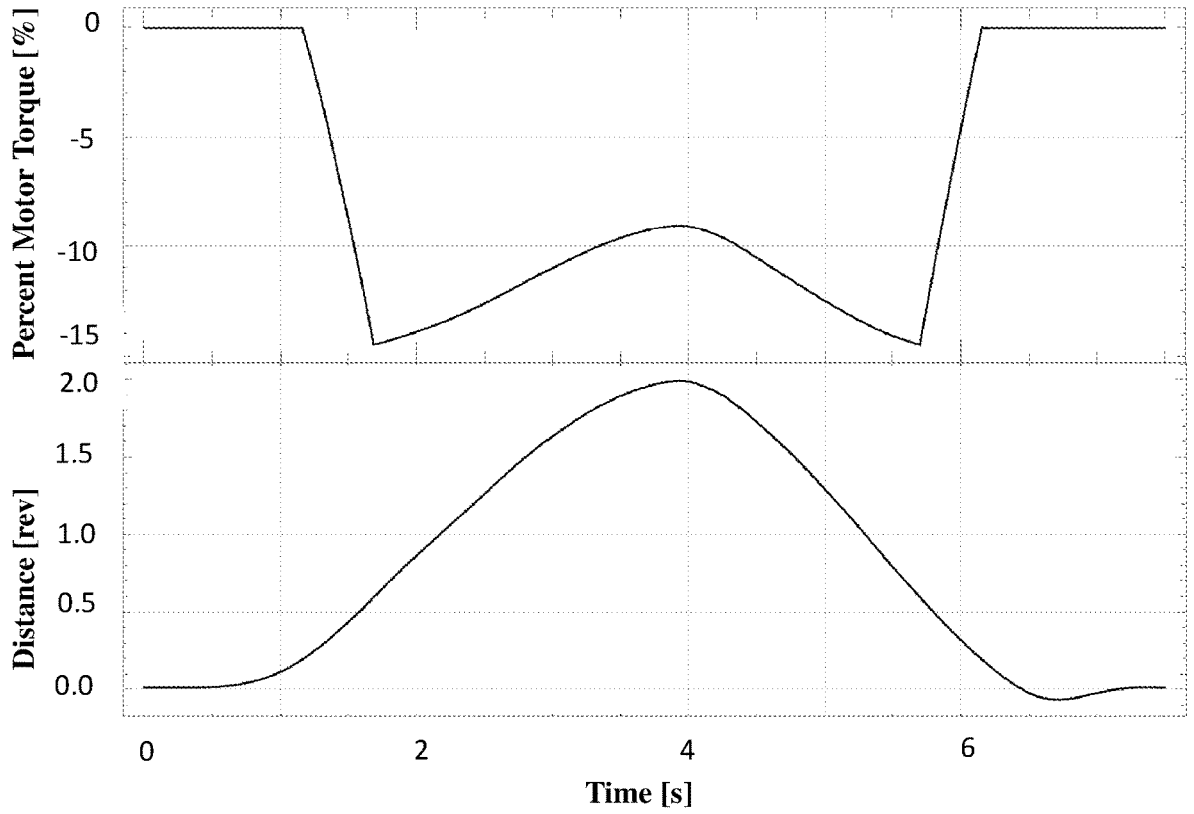
FIG. 14 shows two graphs illustrating an exemplary resistance torque curve, according to an embodiment.

FIG. 14 includes two graphs illustrating an exemplary resistance torque curve. In particular, the bottom graph of FIG. 14 represents the distance (in revolutions) traveled by the fitness wheel 100 with respect to time for one repetition (or "cycle") of the exercise. The top graph of FIG. 14 depicts the percent of motor torque that is applied in correspondence with the distance vs. time curve. Negative torque values in this plot represent torque pulling in the direction of motion of the wheel (resistance in the exercise). FIG. 14 illustrates ramping the torque smoothly at startup and at the end so that there are no torque discontinuities. In the embodiment shown in FIG. 14, the torque pulling away from the user declines with distance (becomes less negative) to make the effort more balanced—the user has to fight the wheel less as she is more fully extended because the user has less leverage in this position (e.g., in the extended position shown in FIG. 6). The effect of lowering the torque in this manner is to make the users effort more balanced throughout the exercise.

Figure 15:
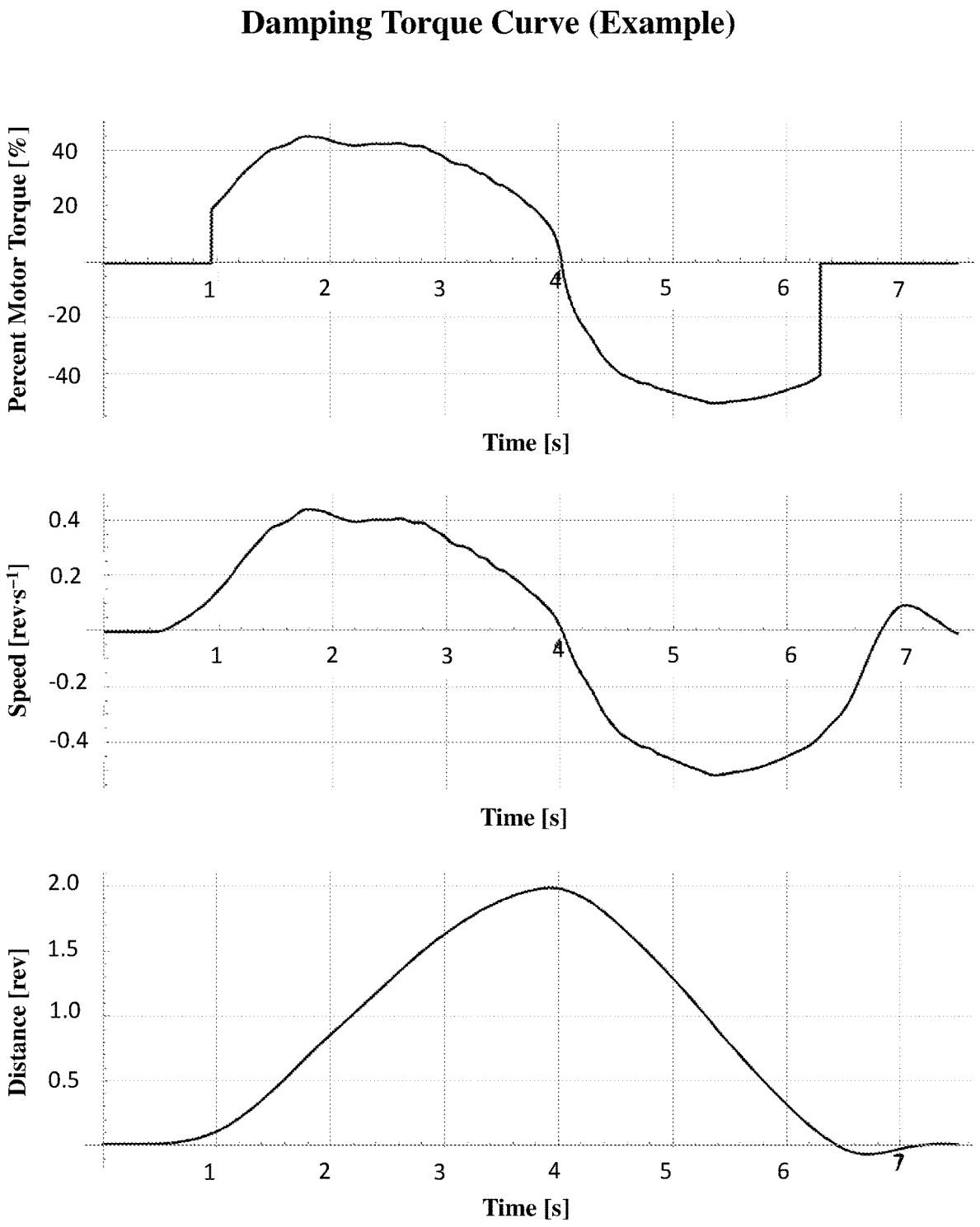
FIG. 15 shows three graphs illustrating an exemplary damping torque curve, according to an embodiment.

FIG. 15 includes three graphs illustrating an exemplary damping torque curve. In particular, the bottom graph of FIG. 15 represents the distance (in revolutions) traveled by the fitness wheel 100 with respect to time for one repetition (or "cycle") of the exercise. More importantly for this exercise, the middle graph of FIG. 15 represents the velocity (in revolutions/sec) of the fitness wheel 100 with respect to time for one repetition (or "cycle") of the exercise. The top graph of FIG. 15 depicts the percent of motor torque that is applied in correspondence with the velocity vs. time curve. Positive torque values in this plot represent torque fighting against positive forward motion of the wheel. In the embodiment shown in FIG. 15, the exercise becomes aerobic because the wheel feels to the user that she is moving through sand. The faster the user tries to move, the more the wheel fights the motion. Although the user is technically getting "assistance" when moving forward and "resistance" when moving in reverse, the damping exercise is aerobic and difficult because the velocity dependency forces the user to actively drive the wheel in both directions. FIG. 15 illustrates an example of a case with a torque discontinuity at startup and at the end. While it is preferable to ramp the torque even in this case, the damping profile is one example in which the discontinuity is not particularly noticeable or troubling to the user. The reason is that this particular exercise is very stable—the wheel never gives the user the sense of "running away" because it reacts only to velocity inputs controlled by the user. The user feels the wheel suddenly starting to resist her motion on startup.

In some embodiments, the microcontroller 210 can be configured to apply a ramp event to ramp up torque at one or more positions or velocities during an exercise. One way to increase muscle activity and intensity is to increase stress near the resting position of the exercise—an area of the exercise that is normally neglected. Thus, the user should be met with a non-zero torque at the beginning of the exercise. Directly commanding a jump in the motor torque imposes a jerky motion on the user's wrists, creating discomfort and risking safety. Instead, it is much more effective to ramp up the torque to the desired level; however, this is not trivial. In actuality, there is a balance between the distance it takes to reach the desired torque and the intensity of the ramp-up. In one embodiment, the wheel has a deadband programmed into it so that no torque is applied for some distance, (for example, 0.2 rotation), after the deadband, there is a ramp-up distance (for example 0.4 rotation) over which the torque is ramped as a linear function of the distance in the ramp-up region (See FIG. 14 for an example). The torque is zero at the beginning of the ramp-up region (0.2 rev in the example) and meets the profile torque at the end of the ramp-up distance (0.6=0.2 rev+0.4 rev in the example).

Additionally, smooth transitions sometimes require ramping the torque in velocity. The boost event illustrated in FIG. 13 demonstrates linearly ramping the torque up 20% as the velocity of the wheel slows below a threshold and reaches full torque near zero velocity. The points in the ramp are labeled in FIG. 13, namely the velocity threshold in which boost is initiated, the zero velocity point and the point at which the torque curve is rejoined.

In some embodiments, the microcontroller 210 can be configured to apply a flutter event for providing feedback at one or more points during an exercise. Flutter is an event implemented by rapidly switching the motor between two values offset from the nominal torque on an arbitrary position along the torque profile. This event produces a vibration throughout the wheel and in one embodiment is constructed in the following manner:

$$\tau_{wheel}=\tau_{nominal}+\tau_{flutter};$$

$$\text{where } \tau_{flutter}=A_{flutter}\sin(2\pi f_{flutter}t). \qquad \text{Eqn. 5.1.1-2}$$

In Equation 5.1.1-2, $\tau_{flutter}$ is the output torque as a function of torque-producing current and time, $\tau_{nominal}$ is the instantaneous commanded torque, $\tau_{flutter}$ is the flutter frequency in Hertz, $A_{flutter}$ is the amplitude of the flutter, $\tau_{wheel}$ is the overall torque commanded to the wheel, and t is time. When the flutter event is patterned, certain messages can be communicated to the user. For example, if the user has rolled out 100% outstretched, they may feel a phone-like vibration to tactically indicate that they should roll back to the resting position and finish the exercise repetition.

Certain exercises may require the user to pause at certain points along the rollout or rollback (e.g., holding a plank, performing a push-up, etc.). Accordingly, in an embodiment, the microcontroller 210 can be configured to apply a hold event at one or more positions during an exercise. The hold event is a nontrivial method for stopping the user in a deliberate yet smooth fashion. Such an effect is designed to mimic the wheel in a divot (e.g., a depression that resists forward or backward movement) on the ground. Hold can be a function of two variables: position and time. For spatial profiles, whether position or velocity based, the hold event is defined to use a position on the exercise path ($x^*_{hold}$) as a marker around which torque is selectively modulated so as to create the "divot" around that position. For temporal profiles, the hold effect is triggered by a prescribed time within the exercise period. Whether exercises are based upon spatial or temporal profiles, once the hold effect is activated, it might last for a period of time before smoothly returning the torque output to the nominal amount. Alternatively, the hold can be turned off if the user pushes through the divot and the normal operation can resume. An example equation is:

$$\tau_{hold} = -A_{hold}v^*\left(1-\left|\frac{x^*-x^*_{hold}}{S_{hold}}\right|\right), \qquad \text{Eqn. 6.1.1}$$

where $\tau_{hold}$ is the total holding torque, defined to be in the opposite direction to the velocity of the wheel, and magnified by the amplitude $A_{hold}$. While Equation 6.1.1 is a damping relationship in essence, the magnitude of damping is controlled by the proximity of the wheel to the holding position, $x^*_{hold}$. The constant, $S_{hold}$, describes the positional range in which the $\tau_{hold}$ takes effect, such that $\tau_{hold}$ lies in the interval $[x^*_{hold}-S_{hold}, x^*_{hold}+S_{hold}]$.

§ 2.4.2.5 Exercises

Combining the building blocks from the above sections (§ 2.4.2.1-4) supplemented with instructional information about exercise form (given in the digital product, such as a smartphone app) yields the end product: an exercise.

§ 2.4.3 Communication

In an embodiment, the fitness wheel 100 is enabled with Bluetooth connectivity and can be integrated with a software app for smartphones and watches. The wheel can be configured to function independently of the smartphone app using the input selection rotary dial. However, the smartphone app can enhance the user experience by adding customization, advanced exercises, and in-app training.

In an embodiment of the fitness wheel 100, a separate Bluetooth and supervisory control microcontroller (e.g., 212) is configured to operate the wheel, and the detailed exercise (i.e., the instantaneous motor torque) is controlled with a second microcontroller (e.g., 214). However, it should be understood that a single microcontroller could be configured to handle both functions.

§ 2.4.4 Safety Mechanisms

As the fitness wheel 100 incorporates the use of a motor, there are some inherent dangers and therefore the fitness wheel preferably is configured to implement safety measures and protocol.

A primary risk of using a motorized fitness wheel is the motor providing unexpected torque or spinning away. This may happen during the middle of the exercise if the user releases the wheel, the wheel is picked up off the floor, or the wheel skids on the surface. All three anomalous events share a single condition: a sudden increase/decrease in wheel speed. Accordingly, in an embodiment, a certain speed threshold can be prescribed, and the microcontroller 210 configured to shut the wheel down if the speed threshold is passed. Alternatively, acceleration can be used as a criterion for an emergency shutdown. Alternatively, if the motor rotates too far for the particular exercise, the microcontroller can shutdown the wheel.

In resistance mode, since the wheel is pulling away from the user, particular attention must be paid to safety. In an embodiment, the wheel will do a damped shutdown if the wheel travels too far (indicative of an anomalous event such as a user picking up the wheel, losing grip of the wheel, or excessive slip of the wheel). The inertia of the handles 7 and stator assembly are intentionally designed to be smaller than the inertia of the rotor and wheel assembly so if a user releases the wheel, the handles would spin but the wheel would remain in place. This is an important safety feature.

Another risk of performing wheel-based exercises with a motorized fitness wheel is overspeeding through the exercise. For the user, improperly performing the range of motion of the exercise with too much speed could lead to muscle strain. Accordingly, in an embodiment, to prevent overspeeding, a manually entered speed limit can be programmed into the software, and the microcontroller is configured to apply a dampening effect on wheel torque when the speed limit is exceeded. Additionally, in an embodiment, if the sensors onboard the wheel detect that there is still excessive force (indicative of abuse), the microcontroller can shut down the motor to prevent overcurrenting.

§ 2.4.5 Reducing Wrist Torque

Figure 16:
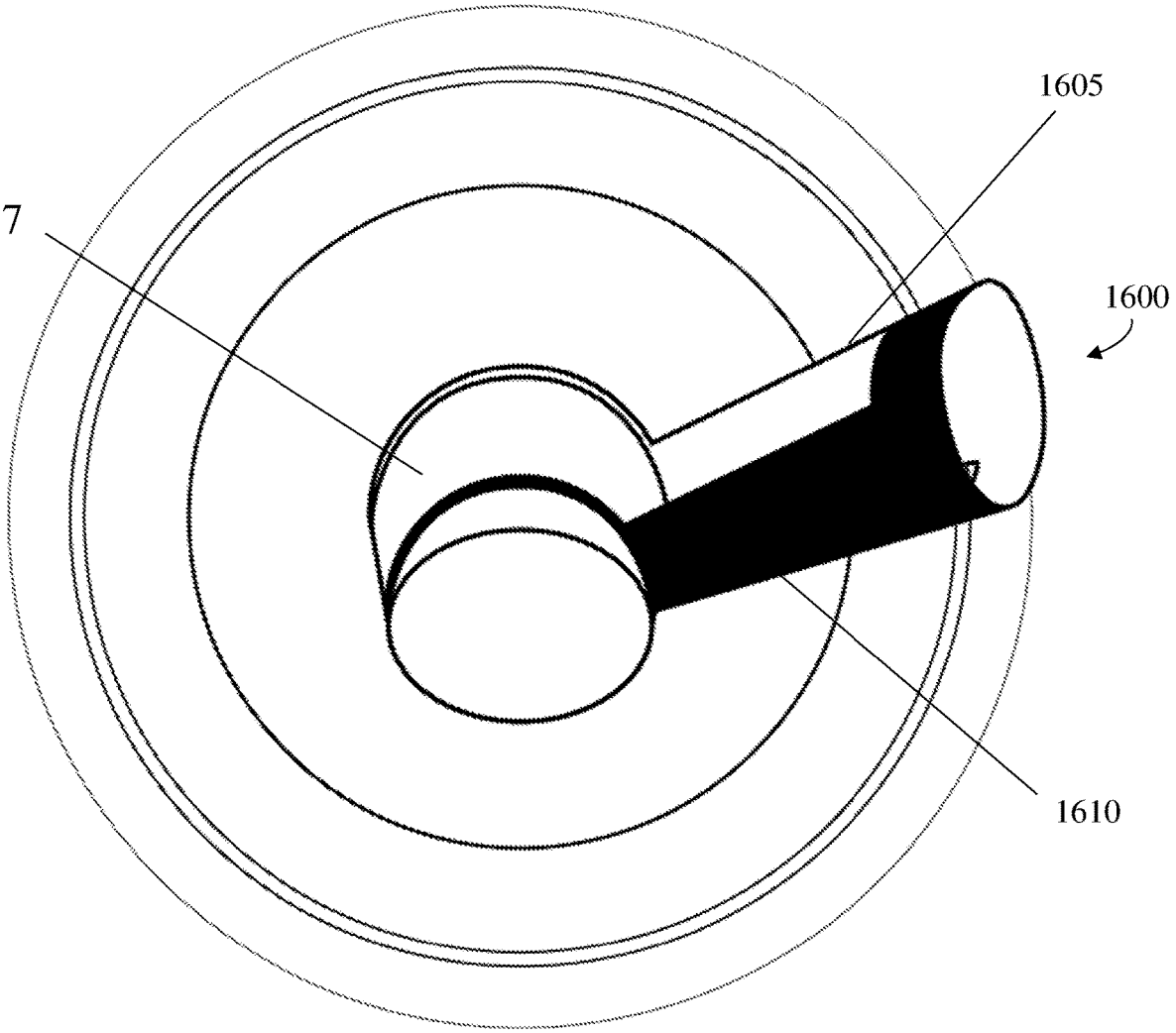
FIG. 16 shows an embodiment of a structure for transferring wrist torque to the user's forearm, according to an embodiment.
Figure 17:
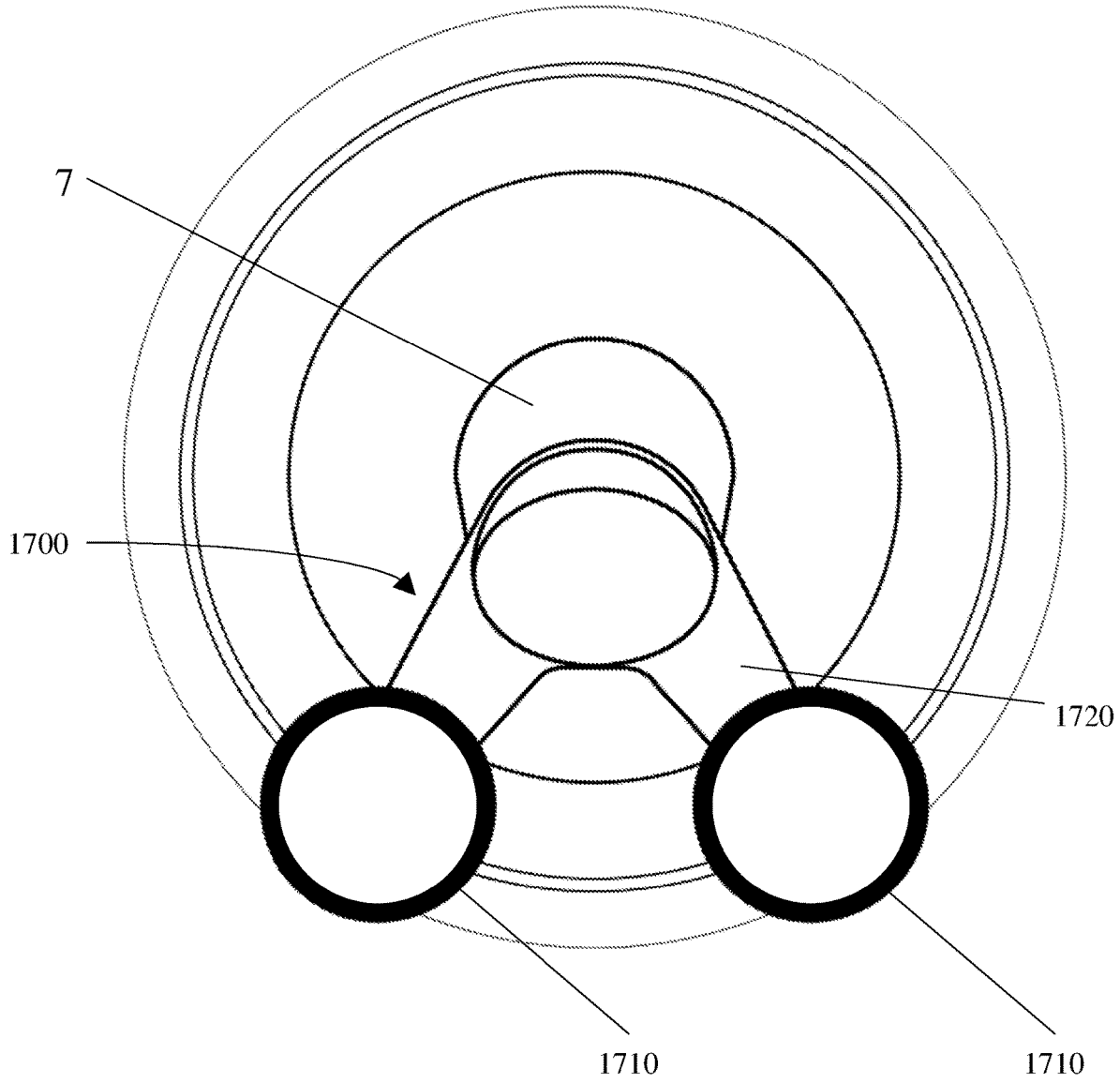
FIG. 17 shows an embodiment of a structure for transferring wrist torque to the floor, according to an embodiment.

The simulations of section 2.4.2.1 demonstrate that the wrists will be subjected to the full torque of the wheel. This is good for building up wrist strength, however, there are instances in which certain users would want/need to reduce wrist stress. In one instance, wrist torque reduction can be achieved by changing the programming of the wheel-either by lowering the torque or slowing the application of torque. In another instance, a wrist torque reduction structure can be optionally added to the fitness wheel 100 to transfer torque from the handles to the forearm in the form of force and shear. For instance, FIG. 16 is a side view of the fitness wheel 100 including an example implementation of a wrist torque reduction structure 1600. Although only one structure 1600 is shown in FIG. 16, it should be understood that a second wrist torque reduction structure 1600 would similarly be attached to the other handle (not shown). The structure 1600 comprises two members extending from the handle 7. One member 1605 is joined to the handle near an inner end of the handle, which is proximate to the hub, and the second member 1610 is joined to the handle near the free end of the handle. Extending between the members is a wrist guard. The wrist guard has a central opening through which the user can insert their hand to grasp the handle. The members 1605, 1610 are joined to the handle in a fixed relationship (i.e., so as to not rotate relative the handle), In another embodiment, a wrist torque structure can comprise wheels and/or glides that are attached to the handles and configured to interact with the floor to reduce or eliminate torque depending on their compliance. For instance, FIG. 17 is a side view of the fitness wheel that further comprises an example implementation of a wrist torque reduction structure 1700, comprising two ground contacting elements 1710 that are attached to the handle 7 using a mount 1720 configured to maintain the elements 1710 in fixed relation to the handle 7. Although not shown, a similar wrist reduction structure can be mounted to the opposite handle.

In another embodiment, the wheel can comprise two, three, or four ground-contacting wheels that are spaced apart in at least the forward/backward direction to provide stability and eliminate wrist torque.

§ 2.4.6 Learning or Adapting to the User

The microcontroller is constantly monitoring the exercise in progress. It can use the data it collects to adapt the exercise for a particular user. For example, by recording the starting position of the exercise and the fully extended position, the wheel can adapt to the height of the user automatically. For example, default settings for a wheel can provide that a user has a given height, say six feet (6'), and, as such, a torque trajectory can be implemented according to the average roll-out distance for a 6' individual. However, during use, the microcontroller can determine from sensor readings whether the actual distance of the user's roll out is consistent with that of the default settings. For instance, the microcontroller might determine that the actual roll-out distance corresponds to a much shorter person, say a five foot tall individual. As can be appreciated, if the torque trajectory defines torque as a function of distance, the portion of the torque curve near the fully extended position would not be reached if the torque curve is unchanged. Accordingly, the microcontroller can be configured to adaptively adjust the torque curve to more optimally fit the actual distance between the starting position and fully extended position, for example, by re-scaling the torque trajectory as a function of the actual distance.

By recording speed throughout the exercise, the wheel can change setting to better control user speed. The wheel can use this information in conjunction with the smartphone application to encourage users to extend more fully, change pace of the exercise among other improvements to the exercise.

In some cases, one key to a good exercise can be slow repetitions and a user that is performing repetitions too fast might not be getting the full benefit of an exercise and risks injury. Accordingly, the microcontroller can be configured to monitor speed and, in the event the microcontroller determines that a person is going to too fast over the course of a cycle (or one or more portions thereof), the microcontroller can be configured to adaptively modulate the output torque so as to force the user to go slower. This can be achieved by the microcontroller reducing the amount of assistance the wheel torque is providing (e.g., to provide less assistance) or apply torque against the motion of the user (e.g., provide more resistance). For instance, if the microcontroller is applying an assistance torque trajectory and determines that the user is moving too fast during roll out, the microcontroller can increase torque against the direction of rotation to slow the user down during roll out. Similarly, if the user is determined to be moving too fast during roll-back, the microcontroller can reduce the amount of assistance (e.g., wheel torque pushing the wheel back toward the starting position) or even provide resistance as necessary to slow the user down accordingly.

The microcontroller can be configured to adaptively adjust the wheel torque using a variety of methods. For instance, the microcontroller can scale the amount of torque by a scaling factor applied to one or more portions of a torque trajectory. In addition or alternatively, the microcontroller can be configured to change the torque trajectory to another torque trajectory that is more suitable for addressing the condition. In certain implementations, the microcontroller can be configured to adaptively adjust torque over an entire cycle, over one or more segments of a cycle, e.g., during roll-out, roll-back, and/or smaller portions thereof, or a combinations of the foregoing. More generally, the microcontroller can be configured to adaptively adjust the torque trajectory based on one or more of a variety of parameters relating to the user's form including, speed, distance, acceleration, torque, and time, among others. Simultaneously, the microcontroller can provide feedback to the user regarding any detected condition or torque adjustment, for instance, by illuminating one or more of the LEDs or outputting a notification via the Application interface to inform the user (e.g., a message "Slow down—you are going to fast").

§ 3 Example Configurations and Practical Scenarios

These and other features of the fitness wheel 100 will be further appreciated from the following discussion of example embodiments of the fitness wheel, and how the fitness wheel is configured to operate when used in various exemplary scenarios.

In an exemplary scenario, the user possesses a motorized fitness 100 wheel without the associated digital interface 250. As noted, the fitness wheel 100 can be configured to be used without the use of a digital interface 250. In such a situation, the microcontroller 210 software onboard the wheel is configured to default to preprogrammed set of trajectories/events, that can be different in assistance, resistance, and neutral modes. In one embodiment, in assistance mode, the applied trajectory can be a nonlinear spring model trajectory, which includes a boost event at the end of the rollout. In resistance mode, for example, the trajectory is composed of a nonlinear spring and constant model, and there are no events. In neutral mode, the trajectory is zero torque, and there are no events (i.e., no assistance or resistance provided by the motor). The built-in trajectories/events can be general enough to allow the user to perform a variety exercises using different sequences of motion (form) without an application.

In an embodiment, the user turns on the motorized fitness wheel by pressing the power button 6. The motorized fitness wheel 100 provides feedback acknowledging a power-on state via an animation on the wheel rim LEDs 2. After the animation, the wheel rim LEDs 2 illuminate to produce solid white light as all the LED-backlit numbers on the exercise difficulty display 3 blink together, prompting the user to choose an exercise difficulty. The numbers to the left of the zero blink green (signifying assistance), and the numbers to the right of the zero blink red (signifying resistance); the zero blinks white (signifying neutral). As the user turns the difficulty selection rotary dial 4, the blinking animation stops, and the LED behind the selected number is solely lit in the appropriate color. The wheel rim LEDs 2 emphasize the selection by matching the color.

The user rotates the difficulty selection rotary dial 4 clockwise to, say, the number 2; after a few seconds, the wheel rim LEDs 2 fade to yellow, signifying that the fitness wheel 100 is ready to be used. The user places the motorized fitness wheel at the start/rest position of the exercise and begins the rollout (i.e., the user extends their body pushing the wheel such that it rolls along the surface in a forward direction). When the microcontroller 210 onboard the wheel has determined, from sensor data, that the wheel has begun rolling, the wheel rim LEDs (illuminated in green for the example selected mode) are turned off, and the microcontroller 210 causes the motor 9 to initiate the designated torque trajectory (e.g., the trajectory of FIG. 13).

Since the user selected assistance mode, the motor controller 214 can be configured to default to a prescribed trajectory. For instance, in an embodiment, the trajectory can be based on a quadratic spring profile, such that the torque response is proportional to the square of the nondimensionalized distance from the starting/resting position. As a result, when the user pushes out from the starting/resting position, the motor pushes opposite to the direction of displacement. This response ensures the user is eased down to the extended position, and then helps the user back to the beginning of the exercise. As the wheel torque increases, the microcontroller 210 causes the LEDs 2 to glow brighter. Additionally, when the user reaches a threshold (e.g., beyond a prescribed displacement from the starting/resting position and below a prescribed velocity), the rim LEDs reach full brightness (green) and the microcontroller 210 activates a boost event. This has the effect of a kickback force, helping the user in the most difficult part of the exercise (extended position) to roll back. As described in § 2.4.2.4, the boost is created by rapidly, but smoothly, increasing the torque above nominal trajectory.

In another embodiment of the fitness wheel 100, the user possesses a motorized fitness wheel and the associated digital interface 250. When the motorized fitness wheel is used with the digital interface 250 enabled on the user's mobile device, the digital interface 250 serves as an extra interface, accompanied with extra features. Most notably, the application running on the digital interface can include a library of exercises and workouts (exercises grouped in a sequence), along with instructional videos to increase the effectiveness of the user's exercise experience. During exercise, the digital interface 250 can be configured to provide a live informational interface for the user to check their repetition count and exercise duration based on information supplied by the microcontroller 210 of the fitness wheel 100 in real time. If the user has a connected health device, information such as heart rate and estimated calorie burn can also be shown on the application interface. The application's dashboard can display any data related to fitness or health progress as chosen by the user. The user also can be provided the option to display recent and favorite exercises directly on the dashboard, such that exercises can easily be revisited on application open.

In this exemplary configuration, the motorized fitness wheel 100 and digital interface 250 are both turned on to startup the system. The user has preferably connected to the wheel before, and so as long as their smart device Bluetooth setting is turned on, the device should automatically connect to the motorized fitness wheel. The motorized fitness wheel signifies to the user that it is connected by sweeping the wheel rim LEDs 2 with blue light. After the sweeping animation, the LEDs pulse in white, prompting the user to choose an exercise on their device.

On the digital interface 250, the user can navigate to the exercise library and choose an exercise, say, to work on their core endurance. The trajectory of the exercise can be, for example, a simple damper profile, meaning that the torque response is proportional and opposite to the velocity in which the user rolls out. Upon selection of an exercise, the related information including trajectories, events and the like can be transmitted to the fitness wheel 100 for storage in the storage medium accessible to the processor and for implementation by the processor (e.g., the microcontroller 210).

After choosing the exercise, wheel rim LEDs 2 change to solid white and the LED-backlit numbers on the exercise difficulty display 3 blink together, prompting the user to select a difficulty. The user may configure the exercise difficulty by either using the selection rotary dial 4 on the wheel or using the application; the latter being configured to allow the user to choose non-integer values (e.g., 2.5, 4.2, etc.). The user sees that the application has remembered and highlighted the most recently used difficulty: 4 on resistance mode.

The user chooses, in-application, to continue with their last used difficulty, and the wheel rim LEDs fade to yellow, signifying that the wheel is ready to be used. The user places the motorized fitness wheel at the start/rest position of the exercise and begins the rollout. When the microcontroller 210 onboard the wheel has determined, from data received from the sensors 215, that the user has begun rolling out, the wheel rim LEDs 2 (illuminated in yellow) turn off, and the microcontroller 210 causes the motor to initiate the designated torque trajectory. For example, the damping mode torque shown in FIG. 15.

As the user pushes outward from the starting/resting point of the exercise, the fitness wheel 100 responds to the velocity according to the torque trajectory. For instance, the faster the wheel is pushed, the greater the amount of torque that is commanded in the opposite direction. The resulting effect is as if the ground is muddy or made of sand. As the user performs each repetition, wheel rim LEDs 2 light up green if the user has passed the threshold distance, designated to represent the full range of motion. In an embodiment, this threshold distance can be estimated based on the user's height information provided in the application. If the user decides not to share their information, the microcontroller 210 can be configured to, by default, define a threshold distance based on an average height or a previously defined threshold distance.

In the digital interface 250, the user can define the number of repetitions they would like to perform before executing the exercise. If this information is provided, the microcontroller 210 can be configured to execute a flutter event at the penultimate repetition, thereby providing haptic feedback to remind the user that the exercise is ending.

The digital interface 250 is intended to offer exercise classes guiding the user with ongoing instruction through an exercise routine. The application can be configured to automatically provide inputs to the microcontroller 210 that serve to change wheel settings such as assistance/resistance level, the trajectory, events and instruct the wheel to signal timing to the user. For example, one part of a routine could be to instruct the user to hold position (as in a "plank" exercise) and wait for the LEDs 2 and/or the flutter of the wheel to indicate to continue with the exercise. The timing of the wheel would be synchronized with the instructions in the software application making a seamless and engaging exercise routine.

Figure 18:
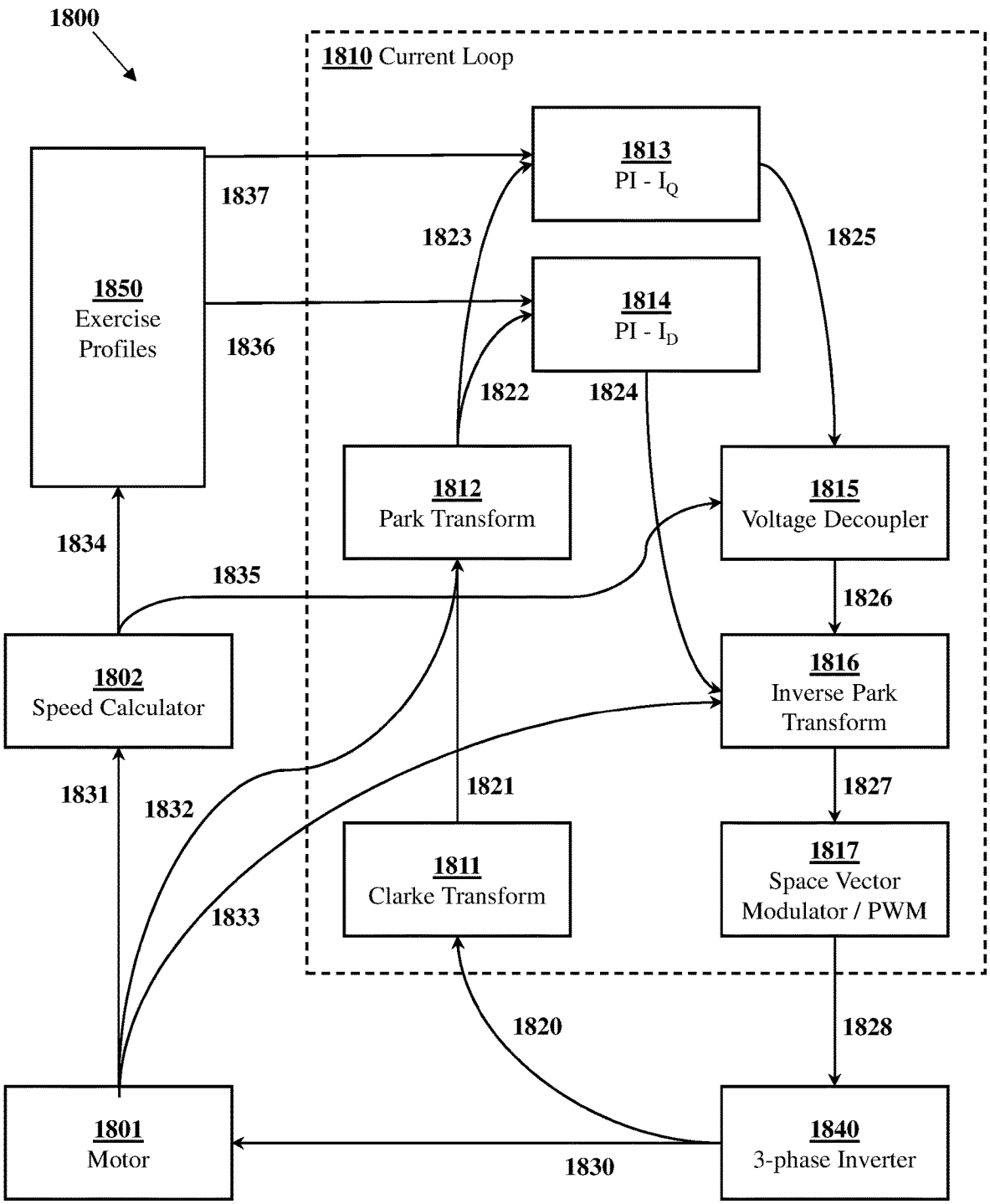
FIG. 18 is a flow chart of an embodiment of a method for operating a motor controller of the fitness wheel of FIG. 1A, according to an embodiment.

FIG. 18 is a hybrid system and process flow diagram of an example embodiment of a method 1800 for operating the motor 9 (shown as motor 1801), which can be implemented by the motor controller 214 according to the present disclosure. After powering on, the motor controller 214 first orients itself by monitoring for a particular hall effect sensor transition. After orientation, the controller enters a current proportional integral (PI) control loop 1810. The motor controller measures and calculates the position (1831, 1832, 1833), velocity (1835) and measured currents of the motor (1820). The position (e.g., rotary angle) and velocity (collectively 1834) are used with the exercise profiles 1850 to determine the DQ reference current commands (1836, 1837). The current and position (1820, 1832, respectively) are provided as feedback to the PI current control loops. In particular, a Clarke Transform, 1811, which is performed on the measured currents (1820), followed by a Park Transform, 1812, which is performed on the output (1821), convert the real {Ia, Ib, Ic} currents in the stationary reference frame to DQ currents in the synchronous reference frame (1822, 1823). The DQ currents are provided as inputs to the PI controllers 1813, 1814. The PI controllers compare the real DQ currents (1822, 1823) to the reference DQ currents (1836, 1837) (e.g., the wanted torque) and calculates DQ current errors (i.e., the currents to get closer to our reference current), which are directed through a PI algorithm. Next, the controllers output DQ voltage commands (1824, 1825) based on the current errors (and their integrals over time). The Q voltage (1825) is corrected for back EMF by the voltage decoupler, 1815. An inverse Park Transform 1816 and a Space Vector Modulator 1817 convert the DQ voltages into PWM duty cycles (1828), for output to the 3-phase inverter, 1840. Three-phase inverter 1840 outputs a PWM voltage signal (1830) to the motor 1801.

The above configurations and features are non-limiting examples, and they are not inclusive of every implementation in accordance with the disclosed embodiments. It should be understood that various combination, alternatives and modifications of the disclosure could be devised by those skilled in the art. The disclosure is intended to embrace all such alternatives, modifications and variances that fall within the scope of the appended claims.

The methods described herein may be performed in part or in full by software or firmware in machine readable form on a tangible (e.g., non-transitory) storage medium. For example, the software or firmware may be in the form of a computer program including computer program code adapted to perform some or all of the steps of any of the methods described herein when the program is run on a computer or suitable hardware device (e.g., FPGA), and where the computer program may be embodied on a computer readable medium. Examples of tangible storage media include computer storage devices having computer-readable media such as disks, thumb drives, flash memory, and the like, and do not include propagated signals. Propagated signals may be present in a tangible storage media, but propagated signals by themselves are not examples of tangible storage media. The software can be suitable for execution on a parallel processor or a serial processor such that the method steps may be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to a viewer. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The terms "a," "an," and "the," as used in this disclosure, means "one or more," unless expressly specified otherwise.

The term "communicating device," as used in this disclosure, means any hardware, firmware, or software that can transmit or receive data packets, instruction signals or data signals over a communication link. The communicating device can include a computer or a server. The communicating device can be portable or stationary.

The term "communication link," or "communication connection," as used in this disclosure, means a wired or wireless medium that conveys data or information between at least two points. The wired or wireless medium can include, for example, a metallic conductor link, a radio frequency (RF) communication link, an Infrared (IR) communication link, or an optical communication link. The RF communication link can include, for example, Wi-Fi, WiMAX, IEEE 802.11, DECT, 0G, 1G, 2G, 3G, 4G or 5G cellular standards, BLE, LoRaWan, or Bluetooth.

The terms "computer" or "computing device," as used in this disclosure, means any machine, device, circuit, component, or module, or any system of machines, devices, circuits, components, or modules which are capable of manipulating data according to one or more instructions, such as, for example, without limitation, a processor, a microprocessor, a microcontroller, a graphics processing unit, a central processing unit, a general purpose computer, a super computer, a personal computer, a laptop computer, a palmtop computer, a notebook computer, a desktop computer, a workstation computer, a server, a server farm, a computer cloud, or an array of processors, microprocessors, microcontrollers, central processing units, general purpose computers, super computers, personal computers, laptop computers, palmtop computers, notebook computers, desktop computers, workstation computers, or servers.

The term "computer-readable medium," as used in this disclosure, means any storage medium that participates in providing data (for example, instructions) that can be read by a computer. Such a medium can take many forms, including non-volatile media and volatile media. Non-volatile media can include, for example, optical or magnetic disks and other persistent memory. Volatile media can include dynamic random access memory (DRAM). Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave, or any other medium from which a computer can read. The computer-readable medium can include a "Cloud," which includes a distribution of files across multiple (for example, thousands of) memory caches on multiple (for example, thousands of) computers.

Various forms of computer readable media can be involved in carrying sequences of instructions to a computer. For example, sequences of instruction (i) can be delivered from a RAM to a processor, (ii) can be carried over a wireless transmission medium, or (iii) can be formatted according to numerous formats, standards or protocols, including, for example, Wi-Fi, WiMAX, IEEE 802.11, DECT, 0G, 1G, 2G, 3G, 4G, or 5G cellular standards, BLE, LoRaWan, or Bluetooth.

The term "database," as used in this disclosure, means any combination of software or hardware, including at least one application or at least one computer. The database can include a structured collection of records or data organized according to a database model, such as, for example, but not limited to at least one of a relational model, a hierarchical model, or a network model. The database can include a database management system application (DBMS) as is known in the art. The at least one application may include, but is not limited to, for example, an application program that can accept connections to service requests from clients by sending back responses to the clients. The database can be configured to run the at least one application, often under heavy workloads, unattended, for extended periods of time with minimal human direction.

The terms "including," "comprising" and their variations, as used in this disclosure, mean "including, but not limited to," unless expressly specified otherwise.

The term "network," as used in this disclosure means, but is not limited to, for example, at least one of a local area network (LAN), a wide area network (WAN), a metropolitan area network (MAN), a personal area network (PAN), a campus area network, a corporate area network, a global area network (GAN), a broadband area network (BAN), a cellular network, or the Internet, any of which can be configured to communicate data via a wireless or a wired communication medium. These networks can run a variety of protocols not limited to TCP/IP, IRC or HTTP.

The term "server," as used in this disclosure, means any combination of software or hardware, including at least one application or at least one computer to perform services for connected clients as part of a client-server architecture. The at least one server application can include, but is not limited to, for example, an application program that can accept connections to service requests from clients by sending back responses to the clients. The server can be configured to run the at least one application, often under heavy workloads, unattended, for extended periods of time with minimal human direction. The server can include a plurality of computers configured, with the at least one application being divided among the computers depending upon the workload. For example, under light loading, the at least one application can run on a single computer. However, under heavy loading, multiple computers can be required to run the at least one application. The server, or any if its computers, can also be used as a workstation.

The term "transmission," as used in this disclosure, means the conveyance of signals via electricity, acoustic waves, light waves and other electromagnetic emissions, such as those generated with communications in the radio frequency (RF) or infrared (IR) spectra. Transmission media for such transmissions can include coaxial cables, copper wire and fiber optics, including the wires that comprise a system bus coupled to the processor.

Devices that are in communication with each other need not be in continuous communication with each other unless expressly specified otherwise. In addition, devices that are in communication with each other may communicate directly or indirectly through one or more intermediaries.

Although process steps, method steps, or algorithms may be described in a sequential or a parallel order, such processes, methods and algorithms may be configured to work in alternate orders. In other words, any sequence or order of steps that may be described in a sequential order does not necessarily indicate a requirement that the steps be performed in that order; some steps may be performed simultaneously. Similarly, if a sequence or order of steps is described in a parallel (or simultaneous) order, such steps can be performed in a sequential order. The steps of the processes, methods or algorithms described in this specification may be performed in any order practical.

When a single device or article is described, it will be readily apparent that more than one device or article may be used in place of a single device or article. Similarly, where more than one device or article is described, it will be readily apparent that a single device or article may be used in place of the more than one device or article. The functionality or the features of a device may be alternatively embodied by one or more other devices which are not explicitly described as having such functionality or features.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, and by structures and functions or steps which are equivalent to these recitations.

What is claimed is:

1. A motorized exercise wheel for performing an exercise having at least one cycle in which a user rolls the wheel along a surface in a forward direction from an approximate resting position to an extended position and then rolls the wheel along the surface in a backward direction from the extended position toward the resting position thus forming an exercise cycle, the motorized exercise wheel comprising:

a wheel assembly including a surface-contacting element, the surface-contacting element being configured to contact the surface and rotate about an axle in either a forward rotational direction or a backward rotational direction and thereby roll along the surface in either the forward or backward direction;

a first and second handle configured to receive each hand of a user, the first and second handle extending outward from respective sides of the wheel assembly;

a motor coupled to the wheel assembly and configured to apply an output torque to the surface-contacting element in either the forward rotational direction or the backward rotational direction;

a microcontroller comprising one or more processors and being configured to control the output torque of the motor;

a first sensor in communication with the microcontroller and useable by the microcontroller to determine a movement variable of the exercise wheel in real-time throughout the exercise cycle, wherein the sensor measures a rotary angle of the motor and wherein the movement variable includes one or more of a position of the exercise wheel, a velocity of the exercise wheel and an acceleration of the exercise wheel;

a non-transitory computer readable storage medium accessible by the microcontroller, wherein the microcontroller is further configured to control the output torque of the motor over the exercise cycle dynamically as a function of the rotary angle, the determined movement variable and one or more torque trajectory parameters, wherein the one or more torque trajectory parameters comprise a torque profile, the torque profile defining a target output torque value of the motor that varies as a function of one or more of the position, the velocity and the acceleration; and a battery on-board the exercise wheel and configured to power the motor and the microcontroller.

2. The motorized exercise wheel of claim 1, wherein the motor is a three-phase motor.

3. The motorized exercise wheel of claim 1, wherein the torque profile is a spatial torque profile that defines the target output torque value as a function of a spatial variable, the spatial variable including one or more of positional, and velocity, information.

4. The motorized exercise wheel of claim 1, wherein the torque profile is a temporal torque profile that defines the target output torque value as a function of a temporal variable, wherein the temporal variable is time.

5. The motorized exercise wheel of claim 1, wherein the one or more torque trajectory parameters comprise a plurality of torque profiles combined, wherein the resulting combined torque profile defines the target output torque value as a function of one or more of a spatial variable and a temporal variable, wherein the spatial variable includes positional information or velocity information, and wherein the temporal variable is time.

6. The motorized exercise wheel of claim 5, wherein the plurality of torque profiles are combined with one or more of piecewise combination, and linear combination based on a weighting function.

7. The motorized exercise wheel of claim 1, wherein the microcontroller is configured to monitor the movement variable to detect an occurrence of a prescribed condition and, in response to detecting the occurrence, control the output torque of the motor over a portion of the exercise cycle based on the torque profile in combination with a supplemental torque event, wherein the supplemental torque event defines the target output torque value for the portion of the exercise cycle as a function of one or more of the position, the velocity and the acceleration.

8. The motorized exercise wheel of claim 1, further comprising a second sensor in operative communication with the microcontroller, the second sensor being configured to measure information representing the output torque of the motor, wherein the second sensor is arranged to feed back the measured information to the microcontroller, and wherein the microcontroller is further configured to control the output torque of the motor as a function of the rotary angle, the target output torque value and the measured sensor information representing the output torque of the motor.

9. The motorized exercise wheel of claim 8, wherein the second sensor comprises one or more of a current sensor and a voltage sensor.

10. The motorized exercise wheel of claim 1, wherein the first sensor is of a type selected from the group consisting of a rotary encoder, a hall effect sensor, and a magnetic sensor.

11. The motorized exercise wheel of claim 1, wherein the torque profile defines the target output torque value according to a function that mimics one or more of a linear spring, a nonlinear spring, a linear damper, a nonlinear damper, and a ramp up to a constant torque.

12. The motorized exercise wheel of claim 1, further comprising:

a user interface in operative communication with the microcontroller and configured to receive a user input indicative of one or more of a plurality of exercise parameters, a plurality of torque trajectory parameters stored in the storage medium; and wherein the microcontroller is configured to, based on the one or more exercise parameters, select a torque trajectory parameter from among the plurality of torque trajectory parameters and control the output torque of the motor according to the selected torque trajectory parameter.

13. The motorized exercise wheel of claim 12, further comprising:

the wheel assembly comprising a first hubcap on a first side of the wheel assembly and a second hubcap on a second side of the wheel assembly opposite the first side; and the user interface mounted to the first handle or the first hubcap, wherein said user interface allows selection among a plurality of settings, wherein the plurality of settings corresponds respectively to the plurality of exercise parameters.

14. The motorized exercise wheel of claim 13, further comprising:

the user interface comprising a rotational selector dial mounted to the first hubcap and rotatable about the first handle between a plurality of rotational positions, wherein the plurality of rotational positions corresponds respectively to the plurality of exercise parameters.

15. The motorized exercise wheel of claim 12, wherein the plurality of exercise parameters includes an exercise mode and a difficulty level, the exercise mode including a resistance mode or an assistance mode, wherein in the assistance mode the microcontroller controls the output torque of the motor so as to make the exercise easier for the user, and wherein in the resistance mode the microcontroller controls the output torque of the motor so as to make the exercise more difficult for the user.

16. The motorized exercise wheel of claim 1, wherein the microcontroller is configured to control the output torque of the motor according to a first torque trajectory parameter during movement of the wheel in the forward direction and a second torque trajectory parameter during movement of the wheel in the backward direction, wherein the first and second torque trajectory parameters are different.

17. The motorized exercise wheel of claim 7, wherein the supplemental torque event generates a boost in torque for the portion of the exercise cycle.

18. The motorized exercise wheel of claim 7, wherein the determined movement variable includes the position and the velocity, wherein the microcontroller monitors the velocity to detect the prescribed condition, wherein the torque profile defines the target output torque value during the exercise cycle as a function of the position, and wherein the supplemental torque event defines the target output torque value for the portion of the exercise cycle as a function of the velocity.

19. The motorized exercise wheel of claim 1, wherein light emitting diode (LODI lights are used to provide visual feedback to the user before, during, or after the exercise.

20. A method of operating a motorized exercise wheel for performing an exercise having at least one cycle in which a user rolls the wheel along a surface in a forward direction from an approximate resting position to an extended position and then rolls the wheel along the surface in a backward direction from the extended position toward the resting position, thus forming an exercise cycle, the wheel having a wheel assembly including a surface contacting element, an electric motor coupled to the wheel assembly, first and second handles extending from the wheel assembly for handling by the user, a microcontroller and a battery onboard the exercise wheel and configured to power the motor and the microcontroller, the method, performed by the microcontroller, comprising:

determining, using a first sensor, a rotary angle of the motor and a movement variable concerning movement of the exercise wheel during the exercise, the rotary angle and the movement variable being determined using the first sensor in real-time throughout the exercise cycle, wherein the movement variable includes one or more of a position of the exercise wheel, a velocity of the exercise wheel and an acceleration of the exercise wheel, determining, a target output torque for the motor dynamically throughout the exercise cycle based on the movement variable determinations and one or more torque trajectory parameters, wherein the one or more torque trajectory parameters comprise a torque profile defining the target output torque value of the motor that varies as a function of the one or more of the position, the velocity and the acceleration; and controlling an output torque of the motor over the exercise cycle as a function of the rotary angle and the determined target output torque.

21. The method of claim 20, wherein the motor is a three-phase motor and of a type having a rotor that is outside of and surrounds a stator.

22. The method of claim 21, wherein the torque profile is one or more of: a spatial torque profile that defines the target output torque value as a function of a spatial variable, the spatial variable including one or more of positional and velocity information, and a temporal torque profile that defines the target output torque value as a function of time.

23. The method of claim 22, wherein the one or more torque trajectory parameters comprises a plurality of torque profiles, wherein a resulting torque profile defines the target output torque value as a function of one or more of the spatial variable and a temporal variable, wherein the spatial variable includes positional information or velocity information, and wherein the temporal variable is time.

24. The method of claim 23, wherein the plurality of torque profiles are combined with one or more of a piecewise combination, and a linear combination based on a weighting function.

25. The method of claim 21, further comprising:

monitoring the movement variable to detect an occurrence of a prescribed condition; and in response to detecting the occurrence, controlling the output torque of the motor over a portion of the exercise cycle based on the torque profile in combination with a supplemental torque event, wherein the supplemental torque event defines the target output torque value for the portion of the exercise cycle as a function of one or more of the position, the velocity and the acceleration.

26. The method of operating a motorized exercise wheel of claim 20, further comprising:

receiving a measurement from a second sensor, the measurement representing the output torque of the motor; and controlling the output torque of the motor as a function of the rotary angle, the target output torque value and the received measurement representing the output torque of the motor.

27. The method of claim 21, further comprising: controlling the output torque of the motor according to a first torque trajectory parameter comprising a first torque profile during movement of the wheel in the forward direction, and controlling the output torque of the motor according to a second torque trajectory parameter comprising a second torque profile during movement of the wheel in the backward direction, wherein the first and second torque trajectory parameters and the first and second torque profiles are different.

28. The method of claim 25, wherein the supplemental torque event generates a boost in torque for the portion of the exercise cycle.

29. The method of claim 25, wherein the determined movement variable includes the position and the velocity, wherein the microcontroller monitors the velocity to detect the prescribed condition, wherein the torque profile defines the target output torque value during the exercise cycle as a function of the velocity, and wherein the supplemental torque event defines the target output torque value for the portion of the exercise cycle as a function of the position.

30. The motorized exercise wheel of claim 1, wherein the microcontroller controls the output torque of the motor according to at least two operational modes among a first, second and third mode, wherein in the first mode the microcontroller controls the output torque of the motor according to a first torque trajectory parameter comprising a first torque profile that, during movement of the exercise wheel in the forward direction, controls the motor to apply torque acting in a direction that opposes movement of the wheel in the forward direction, and during movement of the exercise wheel in the backward direction, controls the motor to apply torque acting in a direction that assists movement of the wheel in the backward direction, wherein in the second mode the microcontroller controls the output torque of the motor according to a second torque trajectory parameter comprising a second torque profile that, during movement of the exercise wheel in the forward direction, controls the motor to apply torque acting in a direction that assists movement of the wheel in the forward direction, and during movement of the exercise wheel in the backward direction, controls the motor to apply torque acting in a direction that resists movement of the wheel in the backward direction, and wherein in the third mode the microcontroller controls the output torque of the motor according to a third torque trajectory parameter comprising a third torque profile that, during movement of the exercise wheel in the forward direction, controls the motor to apply torque acting in a direction that opposes movement of the wheel in the forward direction, and during movement of the exercise wheel in the backward direction, controls the motor to apply torque acting in a direction that opposes movement of the wheel in the backward direction.

* * * * *